US009957021B2

(12) United States Patent
Scott et al.

(10) Patent No.: US 9,957,021 B2
(45) Date of Patent: May 1, 2018

(54) FIN PLUG FOR A WATER CRAFT

(71) Applicant: FIN CONTROL SYSTEMS PTY. LIMITED, Mona Vale, New South Wales (AU)

(72) Inventors: Gregory Scott, Mona Vale (AU); Michael Durante, Mona Vale (AU)

(73) Assignee: FIN CONTROL SYSTEMS PTY. LIMITED, Mona Vale (AU)

( * ) Notice: Subject to any disclaimer, the term of this patent is extended or adjusted under 35 U.S.C. 154(b) by 40 days.

(21) Appl. No.: 14/442,587

(22) PCT Filed: Nov. 14, 2013

(86) PCT No.: PCT/AU2013/001314
§ 371 (c)(1),
(2) Date: May 13, 2015

(87) PCT Pub. No.: WO2014/075138
PCT Pub. Date: May 22, 2014

(65) Prior Publication Data

US 2016/0288882 A1 Oct. 6, 2016

(30) Foreign Application Priority Data

Nov. 14, 2012 (AU) ..... 2012905008

(51) Int. Cl.
*B63B 1/00* (2006.01)
*B63B 35/00* (2006.01)
*B63B 35/79* (2006.01)

(52) U.S. Cl.
CPC ..... *B63B 35/793* (2013.01)

(58) Field of Classification Search
CPC ... B63B 35/79; B63B 35/7926; B63B 35/793; B63B 2035/79; B63B 2035/7903; B63B 2035/81; B63B 2035/813; B63B 39/00; B63B 39/06; B63B 2039/00; B63B 2039/06; B63B 41/00; B63B 2041/00
USPC ..... 441/65, 74, 79; 114/39.12, 39.15, 127, 114/138, 343, 355
See application file for complete search history.

(56) References Cited

U.S. PATENT DOCUMENTS 3,516,099 A 6/1970 Morey et al.
3,564,632 A 2/1971 Bahne, Jr.
3,579,681 A 5/1971 Pope, III et al.
(Continued)

FOREIGN PATENT DOCUMENTS

AU 8447182 7/1981
AU 8415382 5/1982
(Continued)

OTHER PUBLICATIONS

Boardsport SOURCE, 2011.
(Continued)

*Primary Examiner* — Daniel V Venne
(74) *Attorney, Agent, or Firm* — Whitham, Curtis & Cook, P.C.

(57) ABSTRACT

A fin plug (10) for a water craft, said fin plug (10) including: a top surface (15) and a bottom surface (20); at least one fin cavity (25), for receiving a base element of a fin, extending inwardly from at least one opening in the top surface (15); and at least one hole (35) or recess in the top surface (15) adapted to be filled with foam.

21 Claims, 32 Drawing Sheets

(56) References Cited

U.S. PATENT DOCUMENTS 3,585,663 A 6/1971 Johnson
3,659,300 A 5/1972 Johnson
3,879,782 A 4/1975 Oliver
3,890,661 A 6/1975 Johnson
3,965,514 A 6/1976 Shafer et al.
4,044,416 A 8/1977 Brewer et al.
4,325,154 A 4/1982 Collum, Jr.
4,320,546 A 5/1982 Knox
4,379,703 A 4/1983 Mizell
4,398,485 A 8/1983 Diziere
4,421,492 A 12/1983 Leva
4,493,655 A 1/1985 Groff
4,493,665 A 1/1985 Liddle
4,537,143 A 8/1985 Gaide
4,701,144 A 10/1987 DeWitt, III
4,710,144 A 12/1987 Hunt
4,733,496 A 3/1988 Wallner
4,789,368 A 12/1988 D'Onofrio
4,804,347 A 2/1989 Ross
4,805,546 A * 2/1989 Geller ..... B63B 35/7926 114/127
4,846,745 A 7/1989 Lobe
4,850,917 A 7/1989 Wilson et al.
4,854,904 A 8/1989 Wahl
4,904,215 A 2/1990 Sherwood
4,964,826 A 10/1990 Lobe
5,030,151 A 7/1991 Beacham
5,032,096 A 7/1991 Scott et al.
5,112,091 A 5/1992 Kluting
5,133,681 A 7/1992 Lobe
5,148,761 A 9/1992 Winner
5,176,096 A 1/1993 Molnar et al.
5,176,553 A 1/1993 Tuttle
5,215,488 A 6/1993 Bailey
5,224,435 A 9/1993 Billett
5,242,322 A 9/1993 Chellemi et al.
5,273,472 A 12/1993 Skedeleski et al.
5,306,188 A 4/1994 Skedeleski et al.
5,328,397 A 7/1994 Whitty
5,356,324 A 10/1994 Cunningham
5,464,359 A 11/1995 Whitty
5,480,331 A 1/1996 Lewis
5,493,989 A 2/1996 Anderson
5,503,581 A 4/1996 McCullough
5,567,190 A 10/1996 Oates
5,597,337 A 1/1997 Nedderman, Jr.
5,649,846 A 7/1997 Harper et al.
5,672,081 A 9/1997 Whitty
5,830,025 A 11/1998 Fleming
5,934,962 A 8/1999 Daum et al.
5,934,963 A 8/1999 Frizzell
5,951,347 A 9/1999 Hudson et al.
5,975,974 A 11/1999 McCausland
5,997,376 A 12/1999 Block et al.
6,053,789 A 4/2000 Miyashiro
6,068,531 A 5/2000 Patterson
6,106,346 A 8/2000 Bolen
6,139,383 A 10/2000 Jolly et al.
6,213,004 B1 4/2001 Rodgers et al.
6,213,044 B1 * 4/2001 Rodgers ..... B63B 35/793 114/152
6,217,402 B1 4/2001 Bolen
6,244,921 B1 6/2001 Pope
6,247,985 B1 6/2001 Block et al.
6,322,413 B1 11/2001 Webber
6,379,204 B2 4/2002 Bolen
6,386,933 B1 5/2002 Rewald et al.
6,439,940 B1 8/2002 Pouchkarev
6,551,157 B1 4/2003 Bishop
6,595,817 B1 7/2003 Chang
6,695,662 B2 2/2004 Kelley
6,739,925 B2 5/2004 Burns et al.
6,746,292 B2 6/2004 Panzer
6,752,674 B2 6/2004 Jolly
6,764,364 B1 7/2004 Hickman et al.
6,767,266 B2 7/2004 Bolen
6,793,548 B2 9/2004 Jolly et al.
6,821,173 B2 11/2004 McCausland et al.
6,837,763 B1 1/2005 Masteller
D502,522 S 3/2005 Sperafico
6,896,570 B1 5/2005 O'Keefe et al.
6,916,220 B2 7/2005 Davey et al.
6,918,806 B2 7/2005 Skedeleski
6,935,910 B2 8/2005 Laine
RE38,840 E 10/2005 Patterson
6,986,570 B2 1/2006 Jones et al.
6,991,503 B2 1/2006 Garcia
6,991,504 B1 1/2006 English et al.
7,025,645 B1 4/2006 Hsieh
7,029,352 B1 4/2006 Suzuki
7,037,154 B1 5/2006 Suzuki
7,108,571 B2 9/2006 Geraghty
7,117,699 B2 10/2006 Bistline
7,121,911 B1 10/2006 Hickman
7,182,661 B2 2/2007 Sams et al.
7,198,532 B2 4/2007 Field
7,244,157 B2 7/2007 Simpson
7,264,524 B2 9/2007 Batt
7,285,031 B2 10/2007 Mair et al.
7,311,576 B2 12/2007 Pope
7,393,256 B2 7/2008 Clutton et al.
7,497,752 B2 3/2009 Field
7,524,225 B1 4/2009 Richenberg et al.
7,654,168 B2 2/2010 O'Brien et al.
7,896,718 B2 3/2011 Jones
8,393,928 B2 3/2013 Kumano et al.
2001/0006864 A1 7/2001 Bolen
2002/0039866 A1 4/2002 Jolly et al.
2002/0102890 A1 8/2002 Bolen
2002/0155769 A1 10/2002 Herbert et al.
2003/0040236 A1 2/2003 Burns et al.
2003/0087564 A1 5/2003 Kelley
2003/0092333 A1 5/2003 McCausland et al.
2003/0092334 A1 5/2003 McCausland et al.
2003/0124924 A1 7/2003 McCausland et al.
2003/0159475 A1 8/2003 Tan
2003/0220030 A1 11/2003 Jolly
2003/0236039 A1 12/2003 Banys, Jr.
2004/0035346 A1 2/2004 Davey et al.
2004/0043681 A1 3/2004 Jolly et al.
2004/0072483 A1 4/2004 Panzer
2004/0092180 A1 5/2004 Turkington
2004/0214486 A1 10/2004 McCausland et al.
2004/0235374 A1 11/2004 Garcia
2004/0242093 A1 12/2004 Geraghty
2004/0248428 A1 12/2004 Larkin
2004/0248482 A1 12/2004 Larkin
2005/0059304 A1 3/2005 Laine
2005/0064775 A1 3/2005 White
2005/0075017 A1 4/2005 Bistline
2005/0124238 A1 6/2005 Clutton et al.
2005/0142961 A1 6/2005 Tan
2005/0211423 A1 9/2005 Blake, Jr.
2005/0260903 A1 11/2005 Batt
2005/0272326 A1 12/2005 Hopper
2005/0287222 A1 12/2005 Balester
2005/0287888 A1 12/2005 Balester
2006/0019559 A1 1/2006 Mair et al.
2006/0019599 A1 1/2006 Kahlman et al.
2006/0035543 A1 2/2006 English et al.
2006/0166576 A1 7/2006 Pope
2006/0178061 A1 8/2006 Caldwell
2006/0178062 A1 * 8/2006 Caldwell ..... B63B 1/24 441/79
2006/0189230 A1 8/2006 Sams et al.
2007/0218788 A1 9/2007 Field
2008/0191423 A1 8/2008 Cohen
2008/0207070 A1 8/2008 Van Gelder
2008/0220672 A1 9/2008 Koelling
2008/0261470 A1 10/2008 Jones
2008/0268730 A1 10/2008 Heesterman
2008/0311807 A1 12/2008 Luke et al.
2009/0199375 A1 8/2009 Koelling et al.
2009/0253319 A1 10/2009 Ferru

(56) References Cited

U.S. PATENT DOCUMENTS

| | | | | |
|---|---|---|---|---|
| 2010/0120305 | A1 | 5/2010 | Posner et al. | |
| 2010/0136860 | A1 | 6/2010 | Jolly | |
| 2010/0159759 | A1 | 6/2010 | Graden | |
| 2010/0173546 | A1* | 7/2010 | Yeh | B63B 35/793 441/74 |
| 2010/0178820 | A1 | 7/2010 | Kumano et al. | |
| 2010/0233921 | A1 | 9/2010 | Kumano et al. | |
| 2010/0273373 | A1 | 10/2010 | Field | |
| 2010/0279563 | A1 | 11/2010 | Heard et al. | |
| 2010/0311294 | A1 | 12/2010 | Foulke | |
| 2011/0028258 | A1 | 2/2011 | Kumano | |
| 2011/0039463 | A1 | 2/2011 | Hort et al. | |
| 2011/0039464 | A1 | 2/2011 | McTavish | |
| 2011/0053443 | A1 | 3/2011 | McTavish | |
| 2011/0061579 | A1 | 3/2011 | Van Gelder | |
| 2011/0070787 | A1 | 3/2011 | Lausman | |
| 2012/0052755 | A1* | 3/2012 | Durante | B63B 35/793 441/79 |

FOREIGN PATENT DOCUMENTS

| | | | |
|---|---|---|---|
| AU | 8599982 | | 7/1982 |
| AU | 8118387 | A | 2/1987 |
| AU | 3408893 | B | 9/1993 |
| AU | 5937394 | B | 3/1995 |
| AU | 8150294 | A | 6/1995 |
| AU | 199521660 | A1 | 6/1995 |
| AU | 4079996 | B | 4/1996 |
| AU | 21660955 | B | 5/1996 |
| AU | 199739335 | B2 | 10/1996 |
| AU | 199884218 | B3 | 7/1999 |
| AU | 199889534 | B3 | 7/1999 |
| AU | 2006101078 | A5 | 1/2001 |
| AU | 200197113 | A1 | 6/2002 |
| AU | 2002339239 | | 7/2003 |
| AU | 2004203516 | A1 | 2/2005 |
| AU | 2005100116 | B4 | 3/2005 |
| AU | 2004240183 | A1 | 7/2006 |
| AU | 2004240184 | A1 | 7/2006 |
| AU | 2004242515 | B2 | 7/2006 |
| AU | 2006308493 | B2 | 5/2007 |
| AU | 2009100060 | A4 | 2/2009 |
| AU | 2009203058 | A1 | 8/2009 |
| AU | 2009249940 | | 11/2009 |
| AU | 2011200169 | A1 | 3/2011 |
| AU | 2011201840 | A1 | 5/2011 |
| AU | 2013204078 | | 12/2013 |
| BG | 707370 | | 11/1967 |
| BG | 888703 | | 5/1981 |
| CH | 508565 | | 11/1967 |
| CH | 674826 | A5 | 7/1990 |
| CH | 675567 | A5 | 10/1990 |
| CN | 201559803 | U | 8/2015 |
| DE | 2722547 | A1 | 11/1978 |
| DE | 3045412 | A1 | 7/1980 |
| DE | 2932750 | A1 | 3/1981 |
| DE | 2933802 | A1 | 3/1981 |
| DE | 3016927 | A1 | 11/1981 |
| DE | 30416927 | A1 | 6/1982 |
| DE | 3043734 | A1 | 7/1982 |
| DE | 3107896 | A1 | 9/1982 |
| DE | 3149288 | A1 | 8/1983 |
| DE | 3206057 | A1 | 9/1983 |
| DE | 3239441 | A1 | 5/1984 |
| DE | 3246126 | A1 | 6/1984 |
| DE | 3307412 | A1 | 9/1984 |
| DE | 3326894 | A1 | 2/1985 |
| DE | 3440553 | A1 | 3/1985 |
| DE | 3339686 | A1 | 5/1985 |
| DE | 3425233 | A1 | 1/1986 |
| DE | 34942921 | A1 | 6/1986 |
| DE | 3621933 | A1 | 1/1988 |
| DE | 3634445 | A1 | 4/1988 |
| DE | 258710 | A3 | 8/1988 |
| DE | 3729065 | A1 | 3/1989 |
| DE | 3801747 | A1 | 8/1989 |
| DE | 3922815 | A1 | 2/1990 |
| DE | 3907876 | A1 | 9/1990 |
| DE | 4038517 | A1 | 6/1991 |
| DE | 4121541 | A1 | 2/1992 |
| DE | 4122000 | C1 | 10/1992 |
| DE | 4219213 | A1 | 3/1993 |
| DE | 4332216 | A1 | 6/1994 |
| DE | 102005022015 | A1 | 11/2006 |
| EP | 03100686 | A1 | 9/1987 |
| EP | 0476435 | A1 | 9/1991 |
| EP | 1004874 | A2 | 10/2000 |
| EP | 1044874 | A2 | 10/2000 |
| FR | 2510968 | | 2/1983 |
| FR | 2539377 | A1 | 7/1984 |
| FR | 2546243 | A1 | 11/1984 |
| FR | 2576867 | A1 | 8/1986 |
| FR | 2594785 | A1 | 11/1987 |
| FR | 2698673 | A1 | 11/1987 |
| FR | 2613312 | A1 | 10/1988 |
| FR | 2639897 | A1 | 6/1990 |
| FR | 2659931 | A1 | 9/1991 |
| FR | 2667292 | A1 | 4/1992 |
| FR | 2718705 | A1 | 10/1995 |
| FR | 2744981 | A1 | 8/1997 |
| FR | 279280 | A1 | 10/2000 |
| FR | 2823117 | A1 | 10/2002 |
| FR | 2882338 | A1 | 8/2006 |
| FR | 2885875 | A1 | 11/2006 |
| GB | 2010189 | A | 6/1979 |
| GB | 2227461 | A | 8/1990 |
| JP | 2003306195 | | 10/2003 |
| JP | 2005074026 | | 3/2005 |
| JP | 2005112206 | | 4/2005 |
| JP | 2006280839 | | 10/2006 |
| WO | 8201694 | A1 | 5/1982 |
| WO | 8503237 | A1 | 8/1985 |
| WO | 8504141 | A1 | 9/1985 |
| WO | 8807883 | | 10/1988 |
| WO | 8809286 | A1 | 12/1988 |
| WO | 9002589 | A1 | 3/1990 |
| WO | 9013472 | A1 | 11/1990 |
| WO | 9115395 | A1 | 10/1991 |
| WO | 9117080 | A1 | 11/1991 |
| WO | 9308074 | A1 | 4/1993 |
| WO | 9531366 | A1 | 11/1995 |
| WO | 9738895 | A1 | 10/1997 |
| WO | 9746444 | A1 | 12/1997 |
| WO | 9921755 | A1 | 5/1999 |
| WO | 9944884 | A1 | 9/1999 |
| WO | 0030725 | A1 | 6/2000 |
| WO | 0032466 | A1 | 6/2000 |
| WO | 0170565 | A1 | 9/2001 |
| WO | 0032466 | A1 | 6/2002 |
| WO | 0247971 | A1 | 6/2002 |
| WO | 03002405 | A1 | 1/2003 |
| WO | 0304203 | A1 | 5/2003 |
| WO | 03057559 | A1 | 7/2003 |
| WO | 03095301 | A1 | 11/2003 |
| WO | 03099650 | A1 | 12/2003 |
| WO | 2004035377 | A1 | 4/2004 |
| WO | 0132499 | A2 | 5/2004 |
| WO | 200505058 | A1 | 9/2005 |
| WO | 2005105566 | A1 | 11/2005 |
| WO | 2006021029 | A1 | 3/2006 |
| WO | 2006077470 | | 7/2006 |
| WO | 2006077470 | A2 | 7/2006 |
| WO | 2006112871 | A2 | 10/2006 |
| WO | 2006123054 | A1 | 11/2006 |
| WO | 2006135256 | A1 | 12/2006 |
| WO | 2007045059 | A1 | 4/2007 |
| WO | 2007048172 | A1 | 5/2007 |
| WO | 2008006144 | A1 | 1/2008 |
| WO | 2009021267 | | 2/2009 |
| WO | 2009021267 | A1 | 2/2009 |
| WO | 2009023933 | A2 | 2/2009 |
| WO | 2009070852 | A1 | 6/2009 |
| WO | 2009076706 | A1 | 6/2009 |

(56) References Cited

FOREIGN PATENT DOCUMENTS

| | | | |
|---|---|---|---|
| WO | 2009100479 | A1 | 8/2009 |
| WO | 2009142479 | | 11/2009 |
| WO | 2009142479 | A1 | 11/2009 |
| WO | 2010022904 | A2 | 3/2010 |
| WO | 2010115242 | A1 | 10/2010 |
| WO | 2010128870 | A1 | 11/2010 |
| WO | 2011050378 | A2 | 5/2011 |
| WO | 2014008529 | | 1/2014 |

OTHER PUBLICATIONS

Futures Fins Australia 2008 catalogue.
Future Fins Advertisement Sep. 2002.
Future Fins Advertisement Nov. 2002.
Zak Surfboards Blog Oct. 29, 2010 (accessed at http://zaksurfboards.com/future-fins/).
Hawaiian Southshore Surf News, Dec. 2010.
Video on Vimeo.com (https://vimeo.com/21305764) published Mar. 2010—screenshot from 0:20-0:22.
Pullen, Mark. "Statement of Grounds and Particulars." Sep. 17, 2016. Australia.

* cited by examiner

FIN PLUG FOR A WATER CRAFT

FIELD OF THE INVENTION

The present invention relates to a fin plug, for installation in a water craft, such as a surfboard or the like, adapted to enable a fin to be removably attached to the water craft.

BACKGROUND OF THE INVENTION

A water craft, such as a surf-craft, particularly one on which a person stands, kneels or sits, when traversing water or riding a wave, generally has at least one fin in an underside of the craft, generally near the tail end of the craft. Such fins have a number of functions, including: enabling the craft to travel in a desired direction; facilitating the turning of the craft; preventing the craft from slipping sideways; and providing greater control over the movement of the craft, such as when riding a wave.

The following discussion is directed mainly to surf-craft, such as surfboards, but it is to be understood that the discussion applies equally to other water craft (and surf craft) which are adapted to include fins, such as sail boards, paddle boards, kite surf boards, rescue boards, surf skis, kayaks, and the like.

Some surf craft have the fins integrally formed on the surf craft and, for many years, this was the standard means for incorporating fins into such surfcraft. In the last twenty years or so, it has become more common for surfcraft to incorporate a removable fin or, more commonly, fin systems which include a number of removable fins. Such fin systems have numerous benefits, including enabling the fins to be removed for transportation and travelling, allowing damaged fins to be easily replaced and enabling fins of different shapes or styles to be selectively used. Such fin systems typically include at least one fin plug embedded into the underside of the surfcraft. This fin plug generally has at least one cavity adapted to receive a base portion (or a base element) of a surfcraft fin. The surfcraft fin is attached to the surfcraft by securing the base portion (or base element) of the fin into the cavity (or cavities) of the fin plug. There are numerous known fin systems which adopt this general arrangement.

One such known fin system is described in U.S. Pat. No. 5,464,359 in the name of Fin Control Systems Pty Ltd. This system includes fins having 2 projecting base elements (or tabs) and, for each fin, two fin plugs installed in the underside of the surfcraft. Each of the fin plugs has a cavity for receiving one of the base elements. Each fin plug also includes means for securing the base element into the cavity.

An alternative fin system is described in PCT/AU2008/001132, also in the name of Fin Control Systems Pty Ltd. This system also includes fins having 2 projecting base elements. However, these base elements are attachable to a single fin plug, having two cavities for receiving the two corresponding base elements.

Other known fin systems comprise a single fin plug, with a single cavity, for each fin. Typically, such a fin system has quite a large fin plug with an elongated fin cavity for receiving the base element of the fin. The fin plug of such systems also typically includes an upper flat portion having an opening from which the fin cavity extends inwardly and a flange section extending laterally about the opening. This flange section has a particular width. Extending downwardly from an underside of the flat upper portion is a body portion which surrounds the fin cavity. The shape of such a fin plug generally requires two cavities to be routed into the underside of the surfcraft in a two-step process. Firstly, a relatively wide, shallow cavity needs to be formed, the dimensions of which substantially correspond to the shape of the flange section. The depth of this first cavity will substantially correspond with the width of the flange section. Secondly, a narrow, deeper cavity needs to be formed in the first mentioned cavity, which is adapted to receive the body portion of the fin plug. As most surfcraft are designed to accommodate three fins, having to adopt this two-step process for forming each fin plug cavity in the surfcraft substantially slows down the installation process.

Another problem with known fin plugs is that the bond formed between the fin plug and the resinous material with which the fin plug is typically secured within a surfboard blank can be, or can become, flawed, particularly as a result of pressure placed upon the surfcraft fin (which, in use, is connected to the fin plug). The means by which a fin plug is secured within a surfcraft is typically by means of a hardenable liquid resinous material between external surfaces of the fin plug and the wall(s) of the cavity into which the fin plug is inserted.

In the fin system described in U.S. Pat. No. 5,464,359, each of the fin plugs has a top surface (being the surface on which the opening to the cavity is located) and following installation in the surfcraft, this top surface is exposed, being flush with the surface of the underside of the surfcraft.

In the fin system described in PCT patent application number PCT/AU2008/001132 published as WO 2009/021267 A1, each fin plug has a top surface (again being the surface on which the opening to each cavity is located). Following installation in the surfcraft, this top surface is not exposed but, rather, sits under a fiberglass layer. This fiberglass layer above the fin plug top surface is generally continuous with the fiberglass layer of the underside of the surfcraft. The fiberglass layer which sits over the top surface of the fin plug enhances the secure fixation of the fin plug to the surfcraft.

A further problem with most known fin plugs (such as those disclosed in U.S. Pat. No. 5,464,359) is that, when installed in a surfcraft, they are surrounded by the relatively low density foam of which the surfcraft is formed. Such foam may not generally provide sufficient strength to support the loads placed upon the fin plug, due to forces applied to the attached fin, without some deformation, weakening or crushing of the surrounding foam over time. Such deformation or weakening of the foam may cause the fin plug to sink into the foam or to shift out of alignment, with consequential reduction in performance of the attached fin. This can also cause the fiberglass skin, in the vicinity of the fin plug, to crack or shatter. Also, when the fin plug sinks into the foam body, it can cause the top surface of the fin plug to separate from the adjoining fiberglass layer.

Surfcraft fins can be subject to very substantial forces (especially lateral forces) when the surfcraft is undergoing a turn or upon impact with some other object and these forces are then transferred to the corresponding fin plugs to which the fins are attached. These forces can place very substantial strains on the connections (formed of hardened resinous material) between the fin plug and the surfcraft. In turn, these connections can be weakened and, in some cases, the hardened resinous material can crack). These strains upon the abovementioned connections are generally in inverse proportion to the total area of the external surfaces of the fin plug. Accordingly, the smaller this area, the greater will be the strain placed upon the relevant connection.

The present invention is directed towards ameliorating at least some of the above described problems associated with prior art fin plugs and, consequently, the methods of installing these. In particular, one object of the present invention is directed towards providing a fin plug assembly which is adapted to form a stronger bond with the resinous material with which it is secured to a surfcraft.

Any reference herein to known prior art does not, unless the contrary indication appears, constitute an admission that such prior art is commonly known by those skilled in the art to which the invention relates, at the priority date of this application.

SUMMARY OF THE INVENTION

According to a first aspect of the present invention, there is provided a fin plug for a water craft, said fin plug including:

- a top surface and a bottom surface;
- at least one fin cavity, for receiving a base element of a fin, extending inwardly from at least one opening in the top surface; and
- at least one hole extending between the top surface and the bottom surface adapted to be filled with foam.

Preferably, the fin plug includes a plurality of said holes extending between the top surface and the bottom surface. It is further preferred that the fin plug includes a planar portion, having said top surface and bottom surface, and a base portion extending from said bottom surface and surrounding said at least one fin cavity. The planar portion of the fin plug preferably includes a flange extending laterally from said a least one opening to an external perimeter.

In a preferred embodiment of this aspect of the invention, the fin plug includes two fin cavities for receiving two base elements of a water craft fin, said fin cavities extending inwardly from two openings in the top surface of said planar portion.

It is particularly preferred that at least some of the holes extend through the flange of the planar portion.

In another embodiment of the invention, a fin plug for a water craft, said fin plug including:

- a top surface and a bottom surface;
- at least one fin cavity, for receiving a base element of a fin, extending inwardly from at least one opening in the top surface; and
- at least one recess or aperture in the top surface adapted to be filled with foam.

In further embodiment of the first aspect of the invention, the fin plug may have a honeycomb-like structure in that it has a plurality of holes extending from the top surface to a base surface of the base portion of the fin plug. In this embodiment, the holes have a length of up to about 2 cm.

In an alternative embodiment, the holes are located in the planar portion of the fin plug and, in this embodiment; the holes have a length of up to about 0.5 cm. Preferably, the length of these holes is about 0.3 cm. As will be appreciated, the length of the holes is effectively the distance from the top surface to the bottom surface.

It is further preferred that the base portion of said fin plug includes a plurality of rib elements on an external surface thereof. The main purpose of these rib elements is to enhance the strength and/or structural integrity of the fin plug. The rib elements may also enhance the bonding of the fin plug to a surrounding foam body. This base portion preferably includes a wall section and a floor section which are of substantially uniform thickness. A benefit of this uniform thickness is that it reduces the risk of any deformation of these sections of the fin plug during the cooling of the fin plug (following an injection moulding manufacturing process).

The fin plug will typically contain fin retention means serving to keep the fin connected to the water craft (as desired).

In one preferred embodiment, the fin retention means includes a grub screw located within a screw hole which extends from the top surface and communicates with said at least one fin cavity. In an embodiment of the invention in which the fin plug contains two fin cavities, the fin retention means of the fin plug may include one grub screw located within a screw hole which extends from the top surface and communicates with one of said two fin cavities. In a variation of this embodiment, the fin retention means may include two grub screws located within two screw holes, one of which extends from the top surface and communicates with one of said two fin cavities and the other of which extends from the top surface and communicates with the other of said two fin cavities.

In an alternative preferred embodiment, the fin retention means includes a biasing means adapted to impose a lateral force on the base element of the fin located in said fin cavity. This biasing means may include a resilient biasing rod and a protruding member cooperating with the biasing rod, said protruding member being adapted to abut the base portion of said fin when received in said fin cavity. If the fin plug contains two fin cavities it is preferred that the biasing means is adapted only to impose the stated lateral force on the base element of the fin in one of the fin cavities (although it is possible that such a lateral force could be applied within both of the cavities). The biasing rod may be formed of any suitable material such as titanium, steel, marine grade steel, fiberglass, carbon fiber, plastic and reinforced engineering plastic.

It is possible that the fin plug may incorporate both of the fin retention means described in the above two paragraphs.

In a further preferred embodiment, the fin plug may further include fin removal inhibiting means including a ledge portion, within said fin cavity, adapted to overlie a section of the base element of said fin, thereby inhibiting removal of the fin.

The fin plug may be formed of any suitable material, although plastic, thermosets and thermoplastic materials will generally be preferred. Suitable thermoplastic materials include polyamide ('nylon'), acrylonitrile butadiene styrene ('ABS'), polyurethane, polyvinyl chloride (PVC'), polybutylene terepthalate ('PBT'), polyurethane and polyethylene terephthalate ('PET').

According to a second aspect of the present invention, there is provided a fin plug assembly including:

- a fin plug as described above; and
- at least one foam in-fill within the at least one hole extending between the top surface and the bottom surface of said fin plug.

Preferably, the fin plug of the above fin plug assembly includes a plurality of said holes extending between the top surface and the bottom surface and foam in-fills located in at least some of the plurality of holes.

In a preferred embodiment, the foam in-fills are integrally formed or adhered with a foam body which underlies the planar portion of the fin plug. Preferably, this foam body substantially surrounds the base portion of the fin plug. In a particularly preferred embodiment, this foam body includes a sidewall which has a profile which is substantially identical to the external perimeter of the flange of the planar portion. The sidewall is preferably a continuous sidewall which extends about the foam body. Alternatively the sidewall may have a profile as described in detail below.

It is generally preferable that the foam body has a thickness which is substantially equivalent to the distance from the bottom surface of the planar portion to a base surface of the base portion of the fin plug.

In a particularly preferred embodiment of this aspect of the invention, an upper end of each in-fill (or at least most of the in-fills) is substantially flush with said top surface. A benefit of this feature is that it results in enhanced bonding between the fin plug assembly and a superimposed layer of fiberglass and resinous material (during the process of installing the fin plug assembly in a water craft, such as a surfboard).

It is preferred that the foam body and foam infills are formed of a high density foam or a foam as detailed further below.

According to a further aspect of this invention, there is provided a method of manufacturing a fin plug assembly, as described above, said method including the steps:

- provide a fin plug as described above;
- block up each fin cavity of the fin plug to inhibit fluid material entering into said cavity;
- insert the fin plug into an injection mould chamber and inject liquid foam into the chamber so that liquid foam enters into the holes of the fin plug and a foam body forms around the base portion of the fin plug;
- allow the liquid foam to expand and cure so that a fin plug assembly (including the fin plug and cured foam) is formed; and
- remove the fin plug assembly from the chamber.

It is preferred that the above method includes the further step of cutting excess foam from the fin plug plus foam block so that the top surface of the planar portion and the base surface of the base portion of the fin plug are exposed.

In a preferred embodiment of the above method, a further preferred step is the cutting of excess foam from the fin plug plus foam block so as to form a sidewall of the fin plug assembly which has a profile which is substantially identical to the external perimeter of the flange of the planar portion.

In an alternative embodiment of the above method the mould chamber has a shape adapted to form a sidewall of the fin plug assembly which has a profile which is substantially identical to the external perimeter of the flange of the planar portion. This can avoid the need to cut away excess foam from the fin plug plus foam block around the sidewall thereof.

According to another further aspect of this invention, there is provided a method of manufacturing a fin plug assembly, as also described above, said method including the steps:

- provide a fin plug according to the above;
- provide a corresponding, pre-formed foam body to the fin plug; and
- join the fin plug with the foam body.

Preferably, the liquid foam is formed of polyurethane foam, epoxy foam, EPS foam, PVC foam or PET foam. It is further preferred that the liquid foam is adapted to form solid foam when cooled to about room temperature, said solid foam being a high density foam or a foam of substantially similar density as the foam blank of the water craft. For a high density foam a foam density of greater than approximately 50 kg/m$^3$ may be used or more preferably greater than approximately 70 kg/m$^3$.

According to another aspect of this invention, there is provided a method of installing in a water craft a fin plug assembly, as described above, said method including the steps:

- provide a fin plug assembly as described above;
- provide a shaped foam water craft blank;
- make position markings on underside of the water craft blank corresponding to the desired positions for the fin plug in the water craft blank;
- cut out plug hole in underside of water craft blank, said plug hole adapted to receive the fin plug assembly and being of substantially corresponding shape to that of the fin plug assembly;
- pour an amount of resinous material into the plug hole sufficient to form a layer of resinous material between the walls of the plug hole and the corresponding surfaces of the fin plug assembly;
- insert fin plug assembly into plug hole so that the top surface of the fin plug is substantially flush with the underside of the water craft blank;
- apply fiberglass and coating of resinous material to external surfaces of water craft blank, including over top surface of fin plug;
- perform sanding of the surface of the water craft as required; and
- route out layer of fiberglass and resinous material above each fin cavity and the material used to cover or block each fin cavity.

In order to inhibit unwanted resinous material from entering into the fin cavity (or fin cavities) of the fin plug assembly, it is preferred that said cavities are covered or blocked. For instance, any such cavity may be blocked by having (removable) plastic in-fills inserted into them or a sticker sheet or tape applied to the opening of the cavity.

Preferably, prior to the abovementioned step of pouring an amount of resinous material into the plug hole, the following steps are included:

- connect an installation jig to the fin plug assembly by inserting one or more tabs of said installation jig into the at least one fin cavity of the fin plug;
- adjust cant angle and toe angle of the fin as desired and secure installation jig in desired orientation;
- once resinous material has set, remove the installation jig;

When the above preferred steps are involved, then the covering or blocking of the of the fin cavities is undertaken after these steps have been taken.

Preferably, the material used to block up each cavity is a cavity in-fill which may be formed of the same material as the fin plug.

Typically, the water craft is a surfboard and the shaped foam water craft blank will be a shaped foam surfboard blank.

According to a further invention, there is provided a fin plug assembly for a water craft, said fin plug assembly including:

- a fin plug having a top surface, a bottom surface and at least one fin cavity for receiving a base element of a fin, said find cavity extending inwardly from at least one opening in the top surface;
- a first foam layer overlying said top surface, said first foam layer including at least one aperture aligned with, and forming an opening to, said at least one fin cavity; and
- a second foam layer overlying a portion at least of said bottom surface.

Accordingly to a still further invention, there is provided a fin plug assembly for a water craft, said fin plug assembly including:

a fin plug having a top surface, a bottom surface, a perimeter surface and at least one fin cavity for receiving a base element of a fin, said fin cavity extending inwardly from at least one opening in the top surface; and a foam body having a plug cavity in which said fin plug is positioned, said foam body including a peripheral ridge which extends about the perimeter surface of the fin plug.

Further forms of the invention are as set out in the appended claims and as apparent from the description.

BRIEF DESCRIPTION OF THE DRAWINGS

A detailed description of preferred embodiments of the first aspect and the second aspect of the present invention are given hereinafter, while referring to FIGS. 1 and 2.

FIG. 13A is a top perspective view, FIG. 13B is a plan view, FIG. 13C is an end front view, FIG. 13D is a side view from the left, FIG. 13E is an end rear view, FIG. 13F is a bottom perspective view, and FIG. 13G is a bottom view;

FIG. 14A is a top perspective view, FIG. 14B is a view from below; FIG. 14C is a front end view, FIG. 14D is a side view, FIG. 14E is a back end view, and FIG. 14F is a plan view;

FIG. 15A is a top perspective view, FIG. 15B is a view from below, FIG. 15C is another top perspective view, FIG. 15D is a front end view, FIG. 15E is a side view from the left, FIG. 15F is rear end view, FIG. 15G is another side view from the right, FIG. 15H is a bottom perspective view, FIG. 15I is a plan view, and FIG. 15J is another bottom perspective view;

FIG. 16B is a top perspective view, FIG. 16C is a bottom perspective view, FIG. 16D is a side view from the left, FIG. 16E is a plan view, FIG. 16F is a side view from the right, FIG. 16G is an end view, and FIG. 16H is a bottom view; and, FIGS. 17A to 18G are views of examples of other cavity inserts which may be used, in certain circumstances (as described further below), in some embodiments of the invention. In particular.

DETAILED DESCRIPTION OF THE EMBODIMENT OR EMBODIMENTS

An example fin plug 10 is shown in FIGS. 1A, 1B, and 2A to 2H.

Figure 1A:
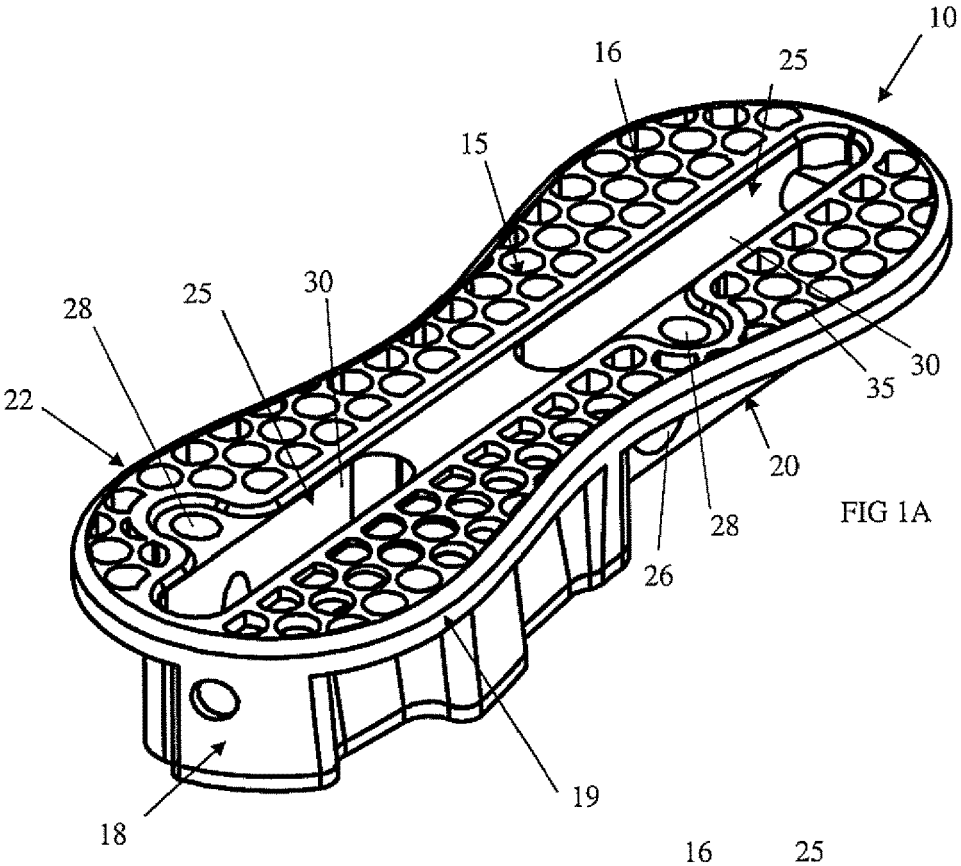
FIGS. 1A and 1B are top perspective views of an example fin plug according to a preferred embodiment of the first aspect of this invention.
Figure 1B:
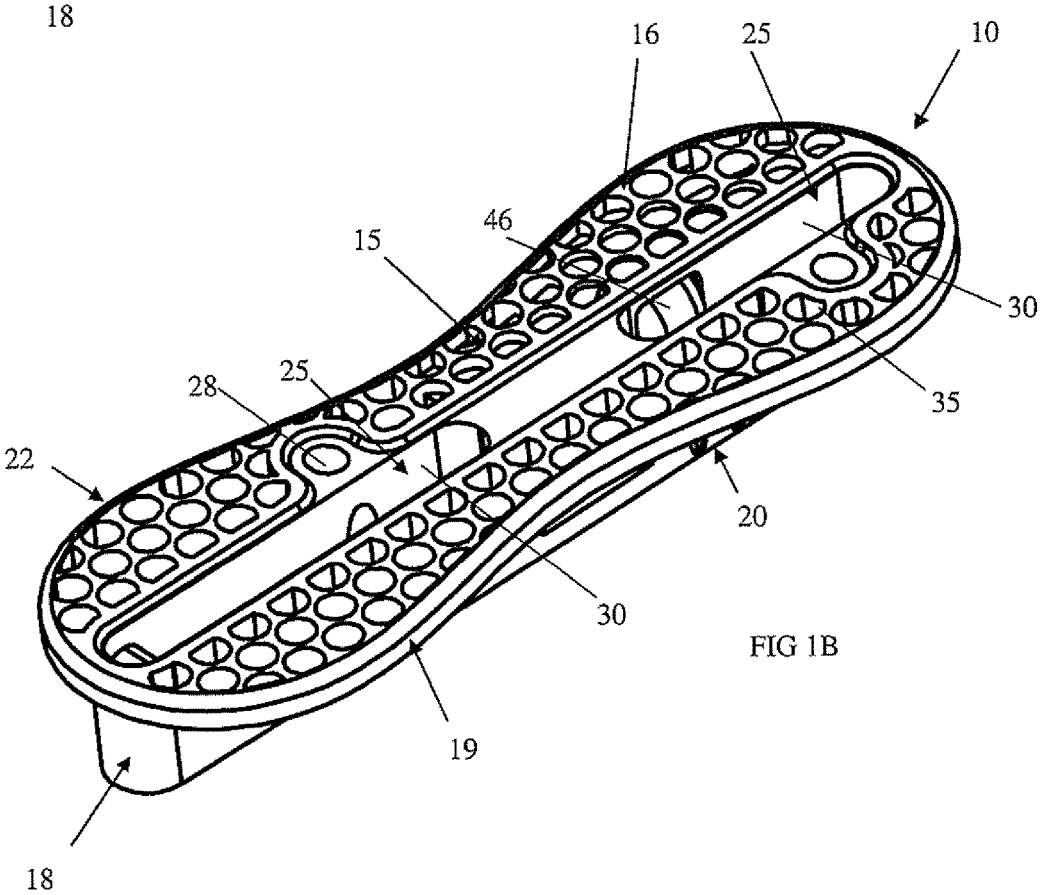

The fin plug 10 of FIGS. 1A and 1B includes a top surface 15 and a bottom surface 20. The fin plug 10 further includes at least one fin cavity 25 for receiving a base element of a surfcraft fin (not shown). The at least one cavity 25 typically extends inwardly from at least one opening 30 in the top surface 15. The fin plug 10 also includes at least one hole 35 extending between the top surface 15 and the bottom surface 20, where the hole 35 is adapted to be filled with foam 40, first described with respect to FIG. 3A and further with respect to FIGS. 10A to 10H.

It will be readily appreciated that the top surface 15 may be curved or otherwise shaped to correspond to the surface profile of a foam blank of a water craft or a surf craft in the position where the fin plug 10 is to be installed. Installation and other details of the fin plug are described in detail further below.

Figure 2A:
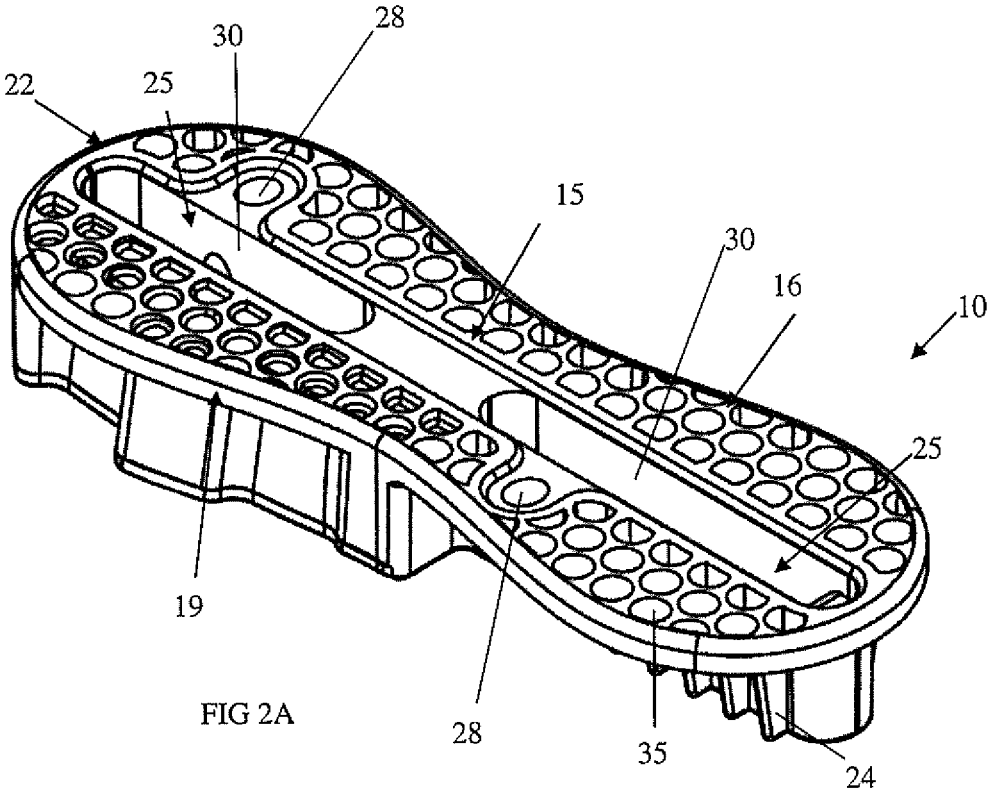
FIGS. 2A and 2B are further top perspective views of the example fin plug of FIGS. 1A and 1B.
Figure 2B:
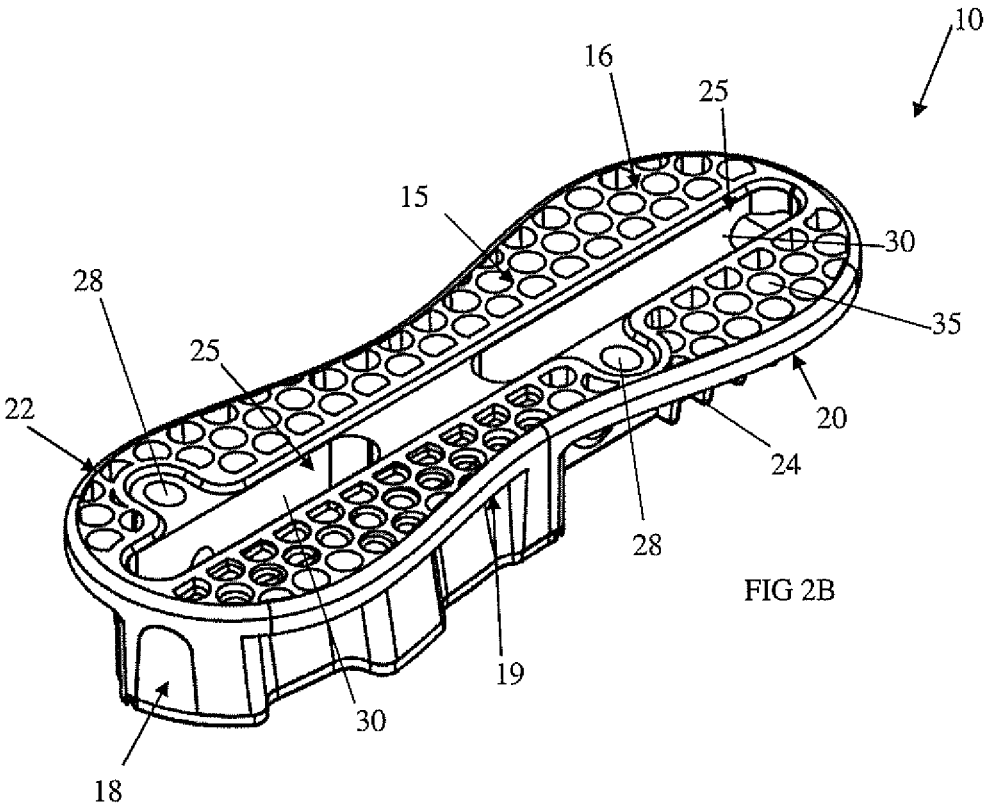
Figure 2C:
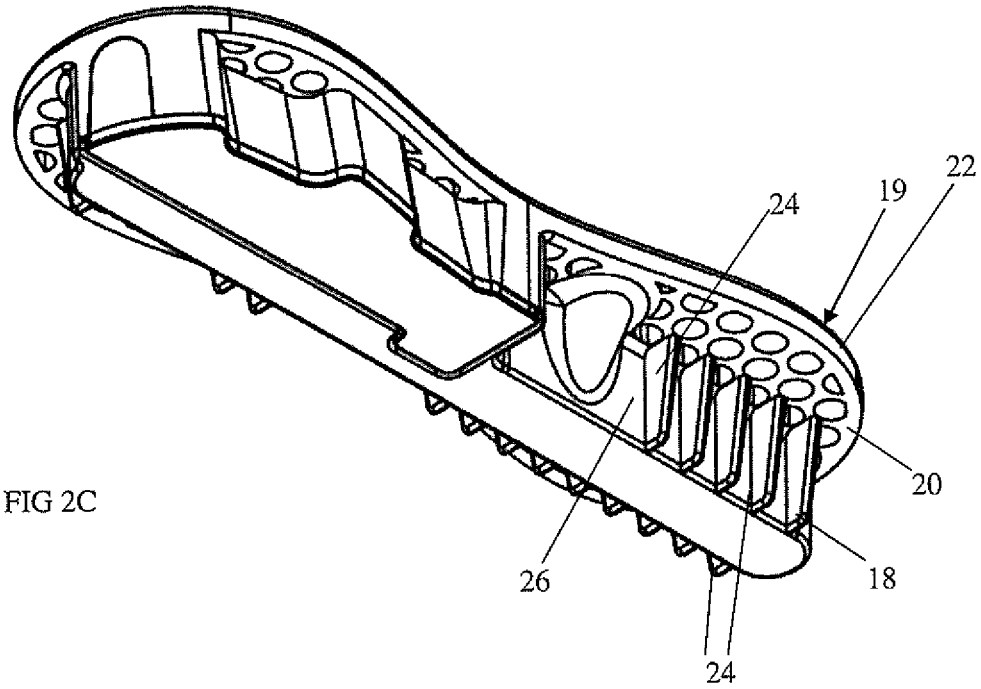
FIGS. 2C and 2D are bottom perspective views of the example fin plug of FIGS. 2A and 2B.

FIGS. 1A and 1B also show that the fin plug 10 can include a plurality of holes 35 which extend between the top surface 15 and the bottom surface 20. Furthermore, FIGS. 2A to 2C show that the fin plug 10 can have a planar portion 16 which includes the top surface 15 and the bottom surface 20. The fin plug 10 can also include a base portion 18 which extends from the bottom surface 20 and surrounds the at least one fin cavity 25.

In one particular example, the planar portion 16 can include a flange 19 extending laterally from the at least one opening 30 to an external perimeter 22 of the fin plug 10. Thus, in this particular example, one or more holes 35 can extend through the flange 19 of the planar portion 16. For example as can been seen in FIGS. 2A and 2C.

It will further be appreciated that the fin plug 10 can include two fin cavities 25 which extend inwardly from two separate openings 30 in the top surface 15 of the planar portion 16.

According to one particular example, the one or more holes 35 are located in the planar portion and have a length or depth of up to 0.5 cm. And yet in a further example, the holes can have a length of about 0.3 cm. As can be seen, the lengths or depths of the holes are substantially equivalent to the distance between the top surface 15 and the bottom surface of the flange 19.

Figure 2D:
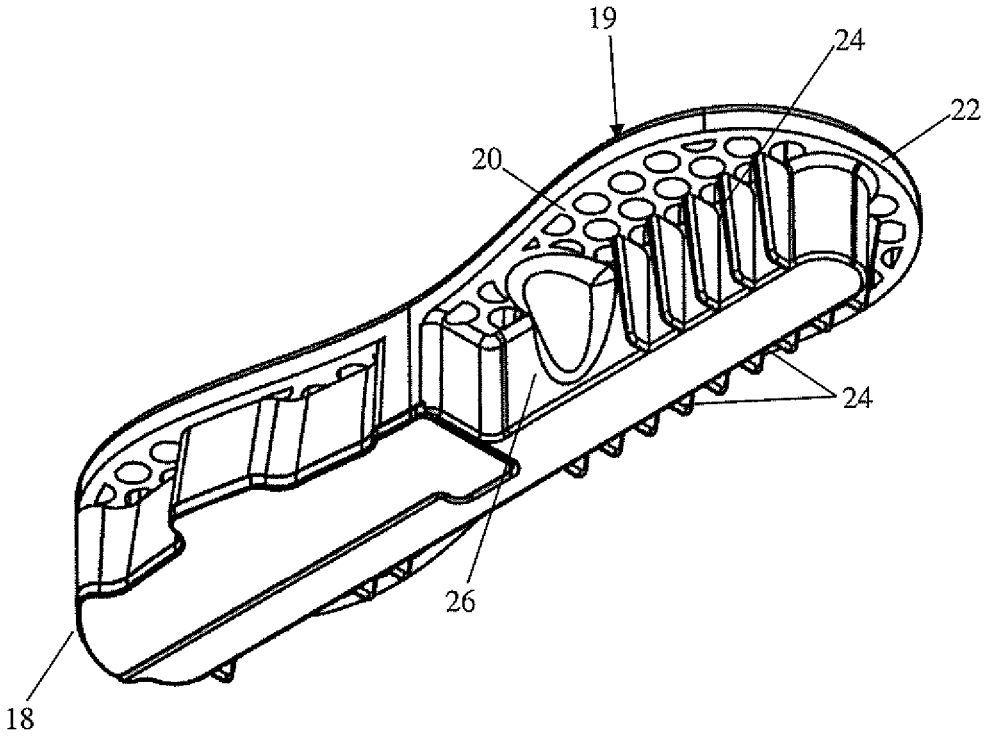
Figure 2E:
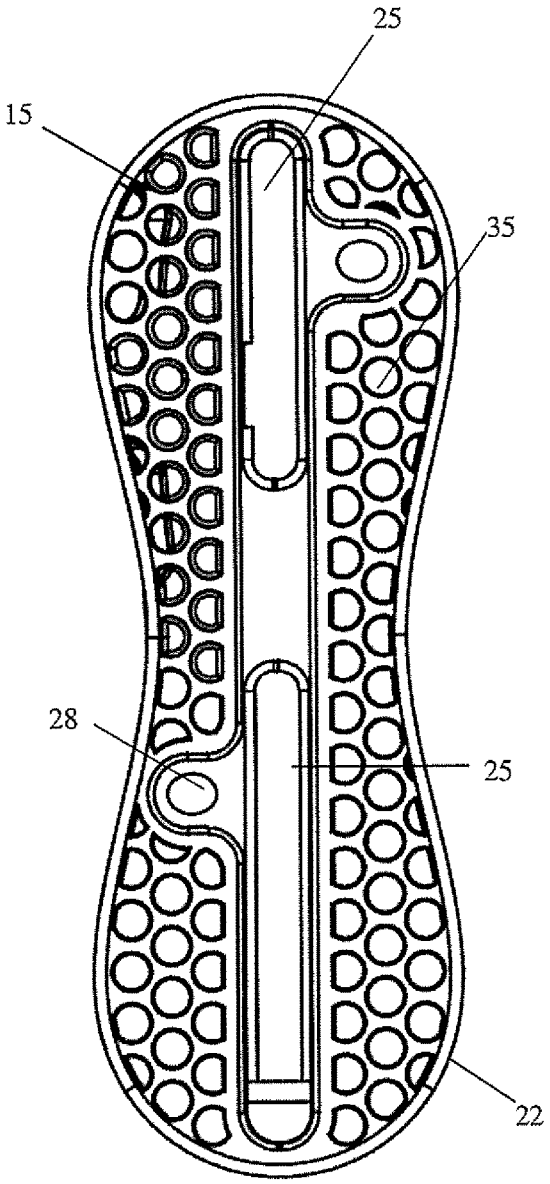
FIG. 2E is a top plan view of the example fin plug of FIGS. 2A and 2B.
Figure 2F:
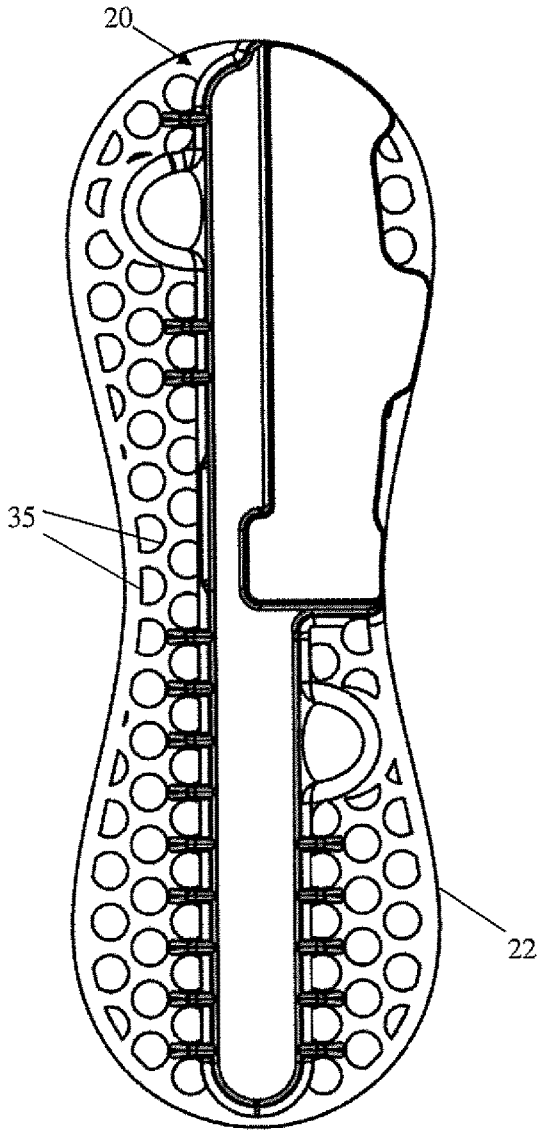
FIG. 2F is a bottom view of the example fin plug of FIGS. 2A and 2B.
Figure 2G:
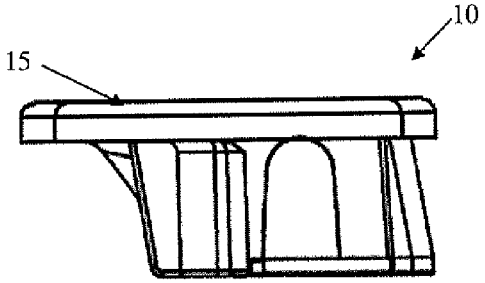
FIG. 2G is a front view of the example fin plug of FIGS. 2A and 2B.
Figure 2H:
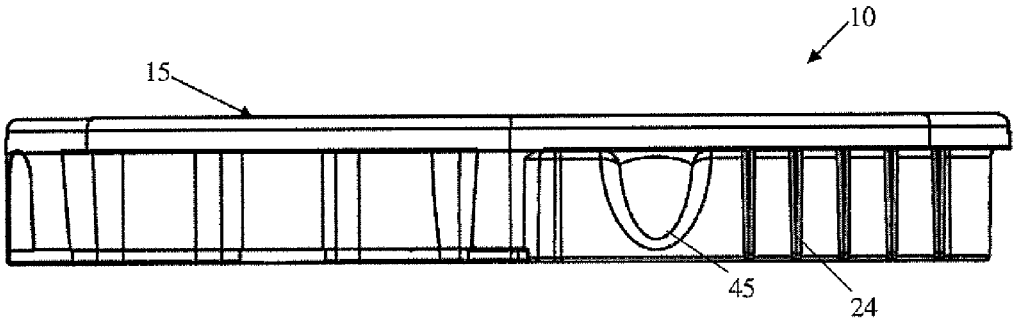
FIG. 2H is a side view of the example fin plug of FIGS. 2A and 2B.

FIGS. 2C and 2D further show that the base portion 18 of the fin plug 10 can include a plurality of rib elements 24 on an external surface 26 of the base portion 18. The rib elements 24 are described in detail below with respect to FIGS. 3A and 3B. Notably, the base portion 18 can also include a wall section and a floor section which are of substantially uniform thickness.

The fin plug 10 can also include a fin retention means or otherwise termed a securing means. In one particular example, as shown in FIGS. 1A, 1B, 2A, and 2B the fin retention means can include a grub screw (not shown) which is configured to be inserted and located into a screw hole 28, which typically extends from the top surface 15 and communicates with the at least one fin cavity 25 to hold a fin of a surfcraft therein.

Notably, there can be provided two or more grub screws located within respective two or more screw holes 28. In this particular example, one of the grub screws can extend from the top surface 15 and communicate with one of said two fin cavities 25 and the other of the grub screws can extend from the top surface 15 and communicates with the other of said two fin cavities 25.

The inclusion of the screw holes 28 (and the grub screws) in the fin plug described above are optional inclusions and may be done, primarily, to accommodate certain known surf craft fins which have fin tabs which extend into the fin cavities 25 and which are typically held in place by means of the grub screws. When such known surf craft fins are secured to the fin plug, the fin tabs may not entirely fill the fin cavities and, consequently, there may be an empty space in the relevant fin cavity. In order to minimise or avoid the presence of any such empty space, a small cavity insert may (optionally) be inserted into the fin cavity to 'fill in' any such space when the water craft or surf craft is fitted with a fin/s and in use. Examples of such, other cavity inserts are shown in FIGS. 17A to 17G and 18A to 18G. These fin cavity inserts in FIGS. 17A to 18G are different to the cavity inserts 50 first described below with respect to FIGS. 3A and 3B. In contrast the cavity inserts 50 are used during the manufacture of the water craft or surf craft.

Figure 6:
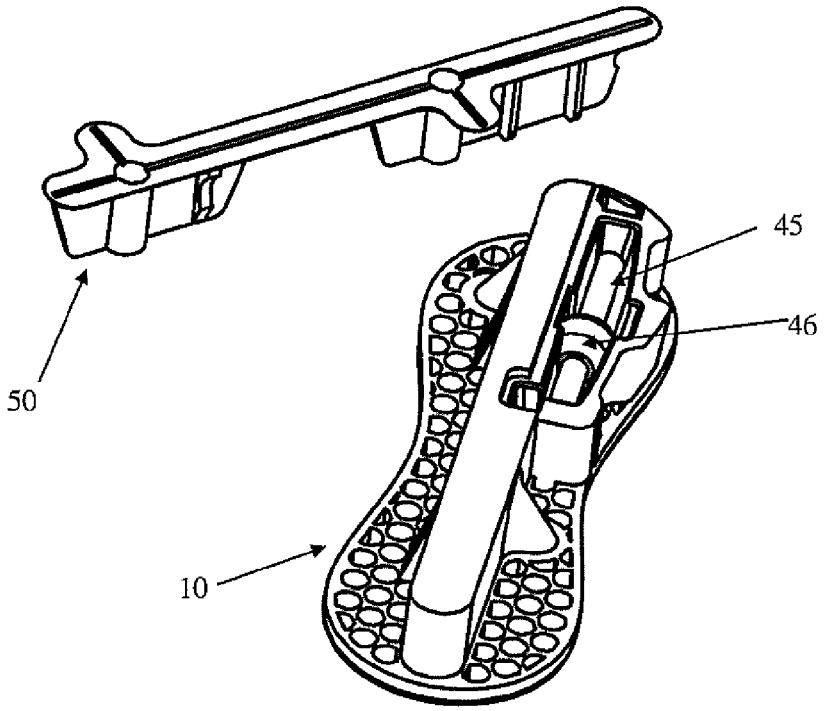
FIGS. 6 and 7 are further perspective views of the fin plug and the cavity insert.
Figure 7:
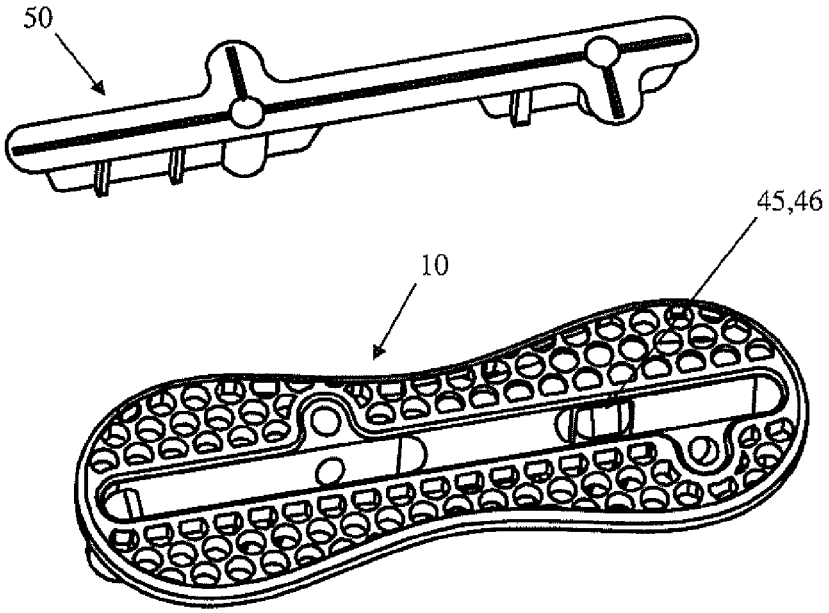

In yet a further example, as shown particularly in FIGS. 1B, 6 and 7, the fin retention means can also include a biasing means 45, which is configured to impose a lateral force on the base element of a fin (not shown) which is located in the cavity 25. The biasing means is described in PCT Patent Application No. PCT/AU2013/000738, "A Fin Plug for Water Craft" filed 5 Jul. 2013, the contents of which are incorporated herein by reference.

Typically, the biasing means 45 includes a resilient biasing rod and a protruding member 46 (as shown in FIG. 6) which cooperates with the biasing rod. The protruding member is typically configured to abut the base portion of the fin, when the fin is received in the fin cavity 25. According to one particular example, the resilient biasing rod is formed of material selected from titanium, steel, marine grade steel, fiberglass, carbon fibre, plastic and reinforced engineering plastic.

In yet a further example of the above reference, the fin plug 10 can also include a fin removal inhibiting means, described below with respect to FIG. 8. The fin removal inhibiting means can have a ledge portion, within said fin cavity 25, where the ledge portion is configured to overlie a section of the base element of the fin, when the fin is inserted within the cavity 25. Thus it can be appreciated that the fin removal inhibiting means can substantially inhibit the removal of the fin from within the cavity 25, once inserted therein.

It will be appreciated by persons skilled in the art that the fin plug 10 may be formed of a thermoplastic, thermoset or plastic material, including but not limited to: a rigid thermoplastic, polyamide ('nylon'), acrylonitrile butadiene styrene ('ABS'), polyethylene, polyvinyl chloride ('PVC'), polyurethane, polybutylene terephthalate ('PBT') and polyethylene terephthalate ('PET').

Figure 3A:
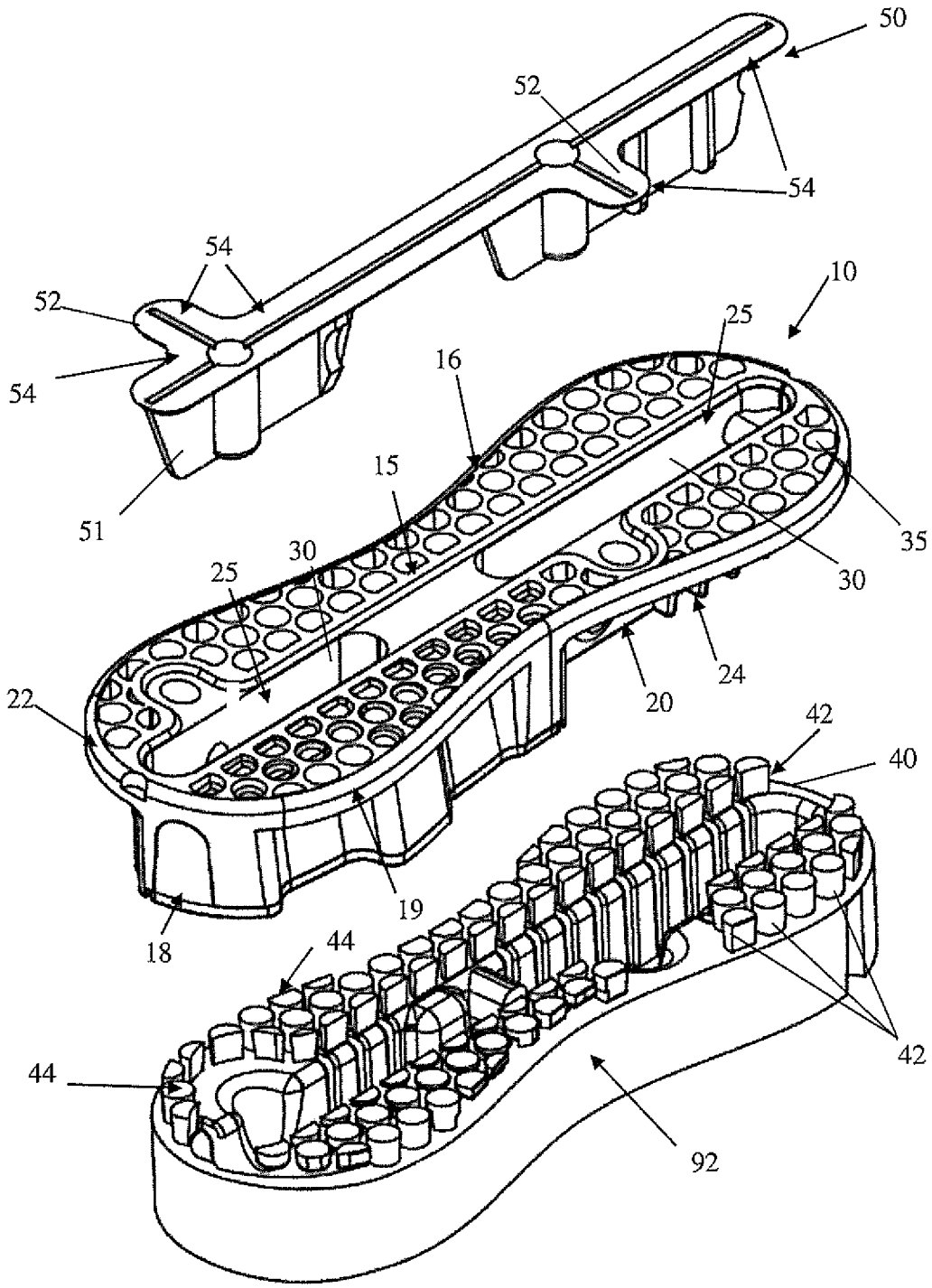
FIG. 3A is an exploded perspective view of an example composite foam and fin plug assembly according to a preferred embodiment of the second aspect of this invention and including a cavity insert for attachment to the fin plug assembly.
Figure 3B:
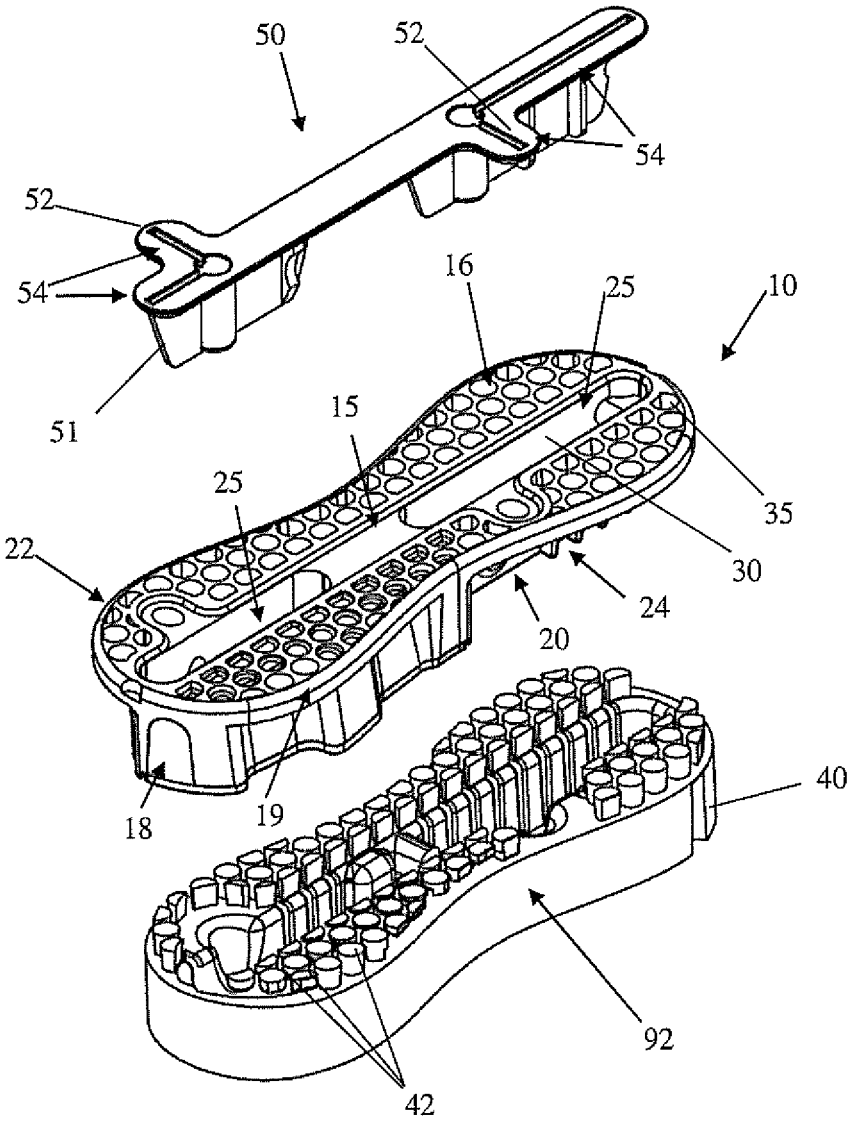
FIG. 3B is another exploded perspective view of an the example fin plug assembly shown in FIG. 3A, again showing the cavity insert for attachment to the fin plug assembly.
Figure 4A:
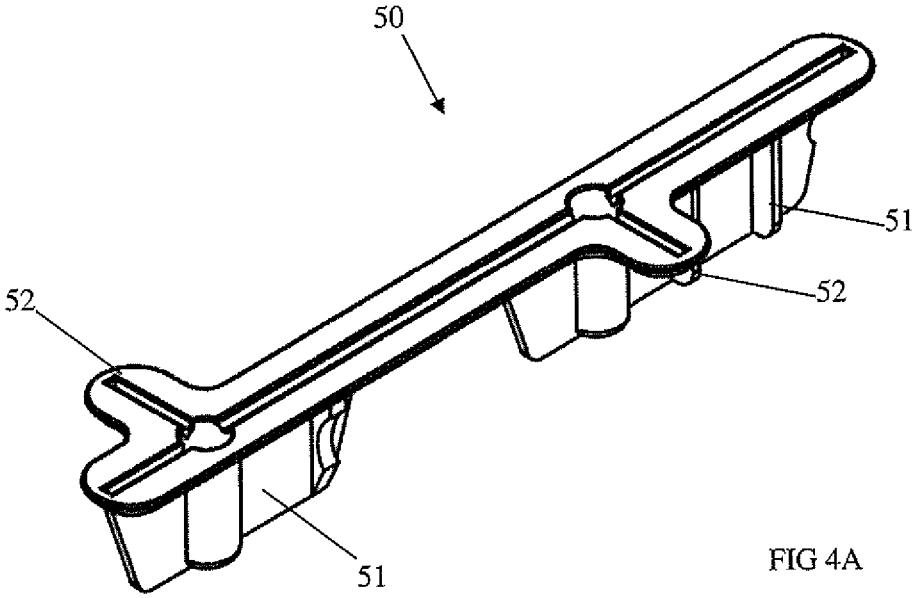
FIGS. 4A and 4B are top perspective views of an example cavity insert which can be used with the fin plug and/or fin plug assembly described herein.
Figure 4B:
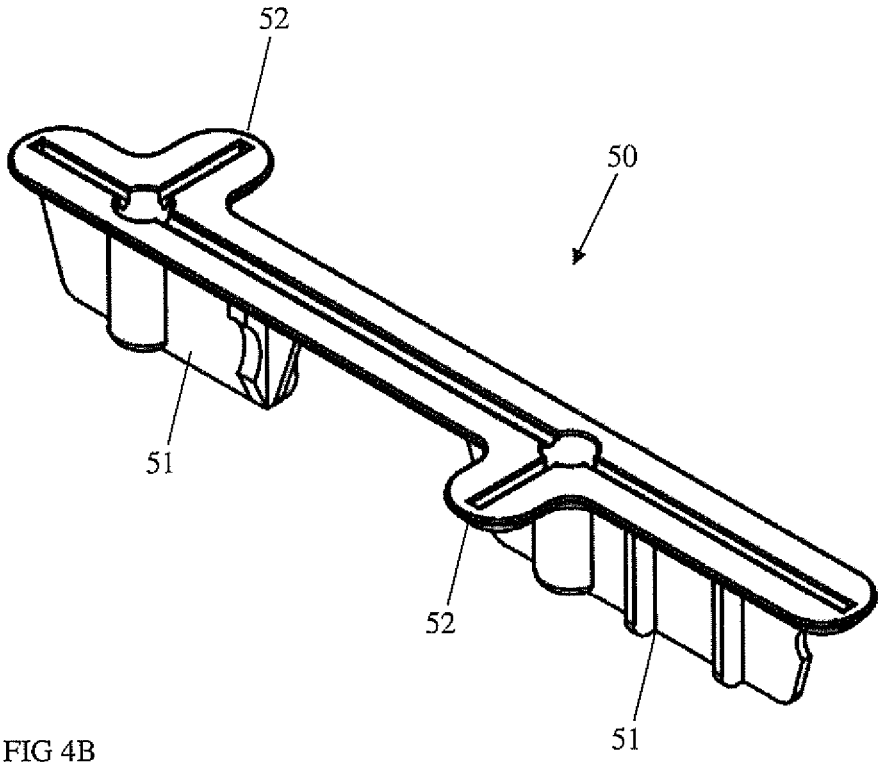
Figure 4C:
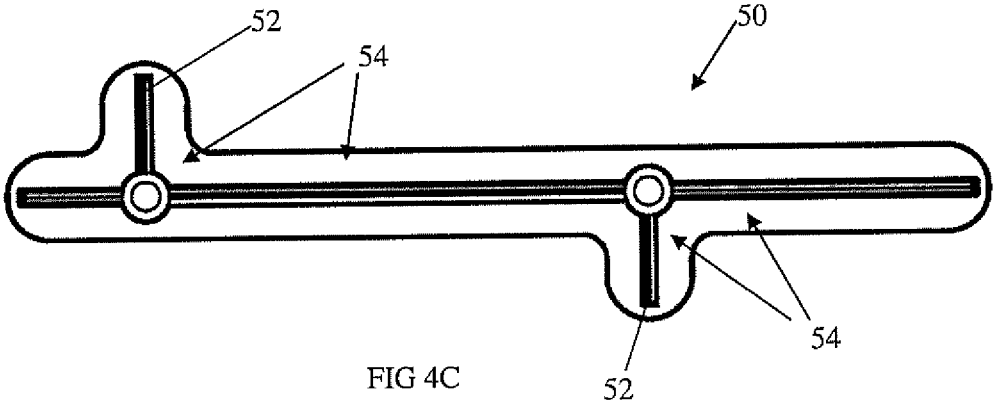
FIG. 4C is a top view of the example cavity insert of FIGS. 4A and 4B.
Figure 4D:
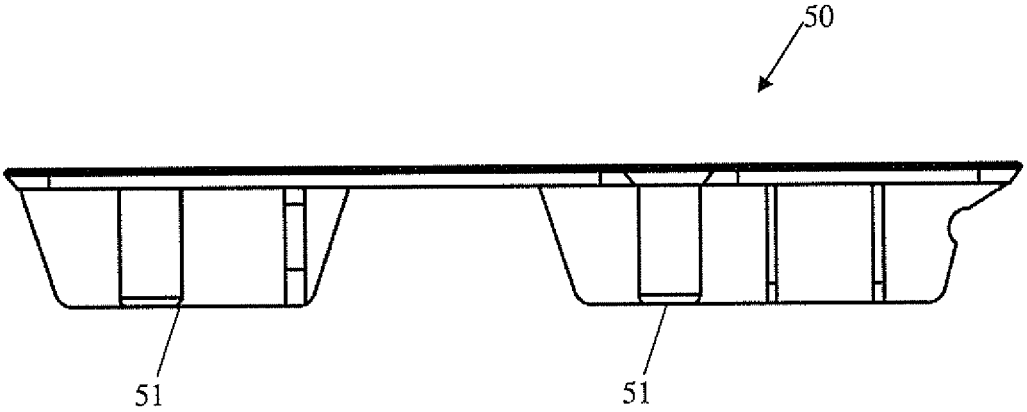
FIG. 4D is a side view of the example cavity insert of FIGS. 4A and 4B.
Figure 4E:
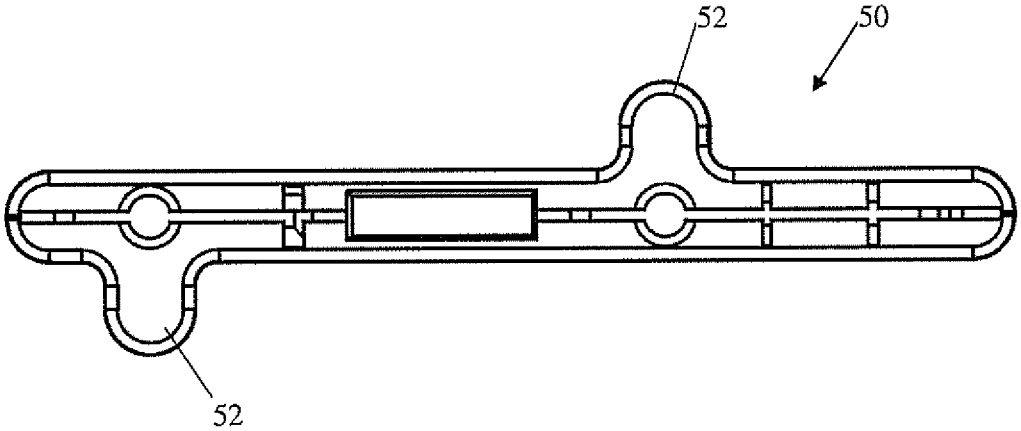
FIG. 4E is a bottom view of the example cavity insert of FIGS. 4A and 4B.
Figure 4F:
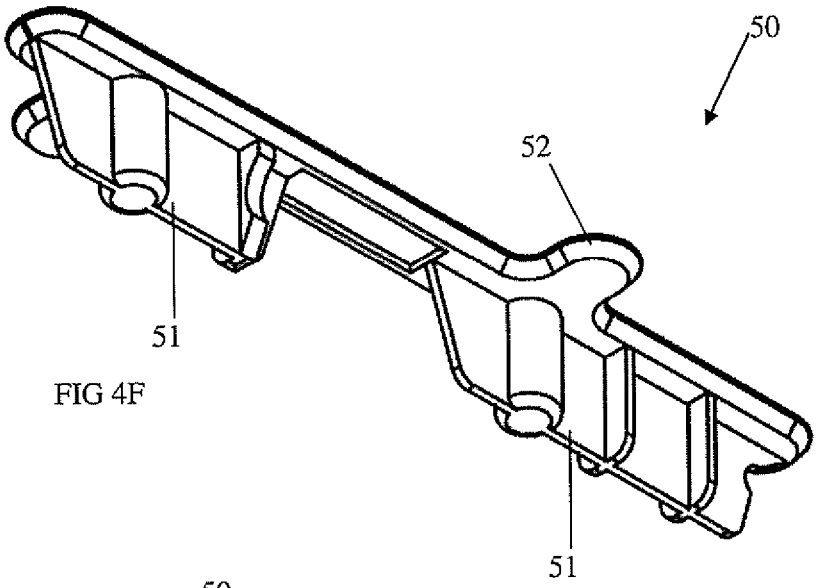
FIG. 4F is a bottom perspective view of the example cavity insert of FIGS. 4A and 4B.
Figure 4G:
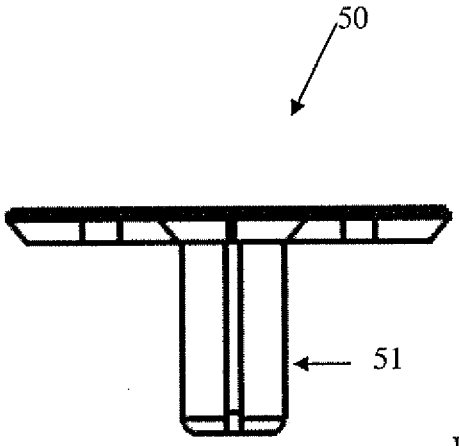
FIGS. 4G and 4H are front end and rear end views of the example cavity insert of FIGS. 4A and 4B.
Figure 4H:
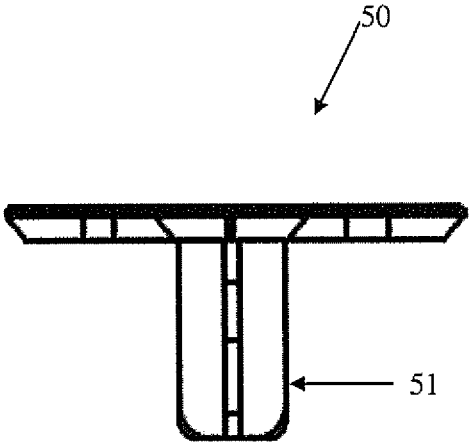

FIGS. 3A and 3B are exploded views of a composite foam and fin plug assembly. The fin plug assembly includes a fin plug 10 and a foam body 40. As described above, the fin plug 10 includes a plurality of holes 35 extending between the top surface 15 and the bottom surface 22. As shown in FIGS. 3A and 3B, the foam body includes a plurality of hole in-fills 42 or projections. These in-fills 42 are positioned in the corresponding holes 35 of the fin plug 10.

The foam body 40 may be formed about and within the fin plug 10 by a foam injection moulding process as described below with respect to FIGS. 10B to 10H and the manufacturing techniques further below. An example of a composite foam and fin plug assembly 90 is shown below with respect to FIG. 10B. Alternatively the foam body may be pre-formed separately to the fin plug. The pre-formed foam body 40 may then be suitably joined or bonded with an adhesive to the fin plug to form a composite foam and fin plug assembly. The pre-formed foam body 40 may be joined with the fin plug prior to installation in the water craft foam blank or separately installed as described further below.

A purpose of the rib elements 24 is to enhance the strength and/or structural integrity of the fin plug 10. The rib elements 24 may also enhance the bonding of the fin plug and mechanical coupling of the fin plug to a surrounding foam body as shown in FIGS. 3A and 3B and further in FIGS. 10A to 10H, 15A to 15J and 16A to 16H. In those Figures it is readily apparent that the rib elements 24 increase the surface area of interaction between the fin plug and the foam body/foam infill 40 which has advantages in bonding and transmitting of high forces between the fin, the fin plug, the foam body/foam infill and the foam blank of the body of the water craft or surf craft.

It will be appreciated that, when in the final stages of manufacturing the surf craft, as described below, a cavity insert 50 (for example FIGS. 3A, 3B and 4A to 4H) can be used to inhibit resinous material from entering the cavities 25 from the final stages of the manufacturing process. The final stages often includes inserting the fin plug 10 or the fin plug assembly (as described herein) into the underside of a surf craft and then pouring resinous material over the surface of the underside of the surf craft and, consequently, over the fin plug 10 or fin plug assembly. Thus, by inserting a cavity insert 50 into the cavities 25, prior to the pouring of the resinous material; the resinous material can be kept out of the cavities. The cavity inserts can subsequently be removed (e.g. by sanding or routing) enabling the cavities to be revealed. The cavity insert 50 when inserted into the fin cavity 25 is flush to the top surface 15 of the fin plug. The cavity inserts also feature cross hair markings 54, shown in FIGS. 3A and 3B, which may be used to aid in positioning cutting tools used in the installation process for the fin plug. Examples of installation procedures are described further below.

The cavity insert may be made of the same or similar materials to that described above for the fin plug. Preferably the cavity insert is formed of a material which has poor adhesion to the resinous material, other adhesives and the foam. Alternatively a person skilled in the art may select an appropriate material for the cavity insert and the application of the glass layer 60, resins, adhesives and fillers.

FIGS. 4A to 4H show various views of the cavity insert 50, and FIGS. 3A and 3B show examples of how the cavity insert 50 can be inserted into the cavities 25. Thus, in this particular example, the cavity insert 50 is formed to have legs 51, which are formed so as to be received in the corresponding cavities 25, for instance by way of a friction fit or snap-fit.

Furthermore, as shown in FIGS. 3A to 4G, the cavity insert 50 can be elongate and is formed to cover both cavities 25, and further can also include a necked portion 52 to cover holes where grub screws or the like are to be inserted into. However, it will be appreciated that two separate cavity inserts (one for each cavity 25) can also be used.

Figure 5A:
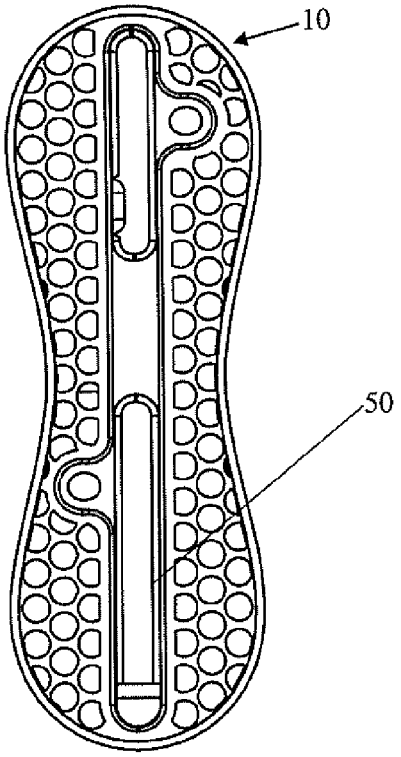
FIG. 5A is a top plan view of an example composite foam and fin plug assembly with a cavity insert prior to installation into a surf craft.
Figure 5B:
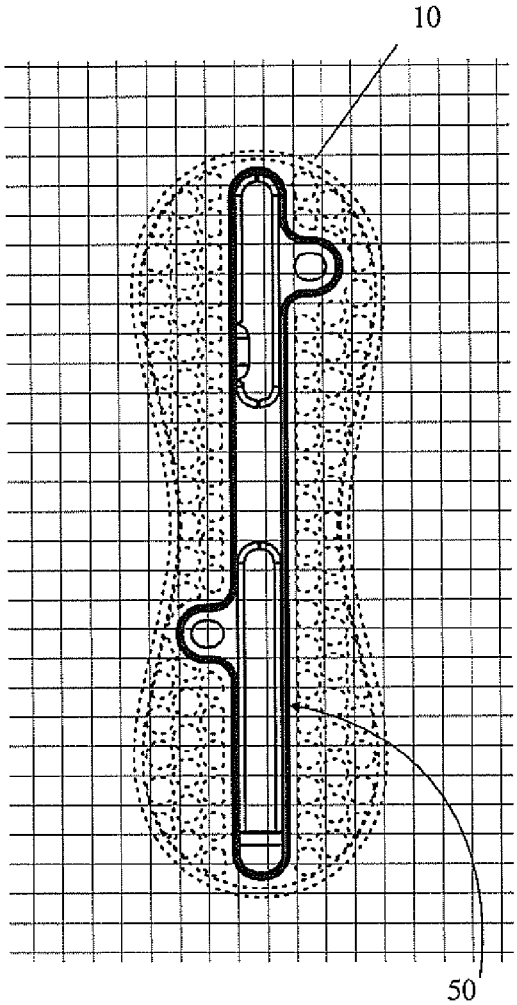
FIG. 5B is a top plan view of the example fin plug assembly of FIG. 5A installed within a section of a surf craft.
Figure 5C:
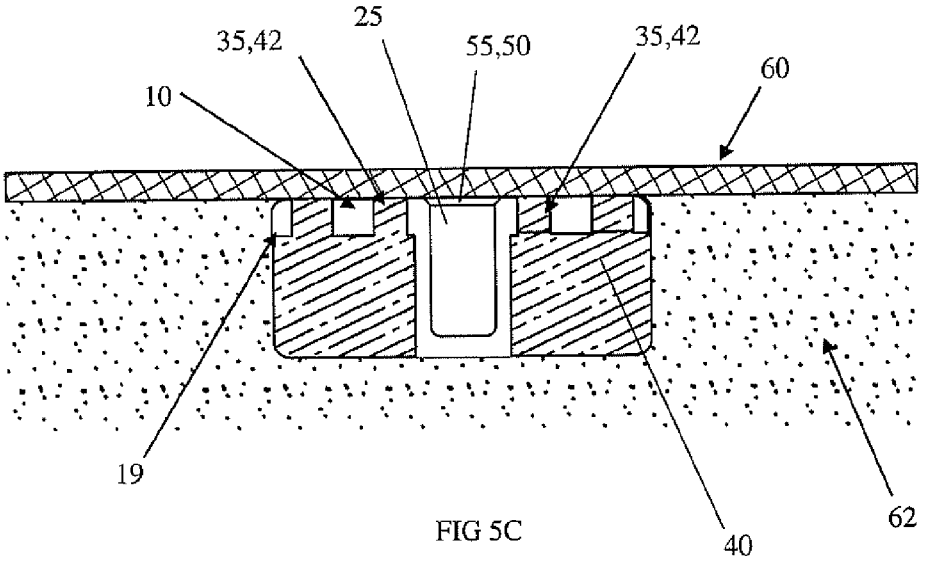
FIG. 5C is a cross-sectional view transversely through a fin cavity of another example of a composite foam and fin plug assembly.
Figure 5D:
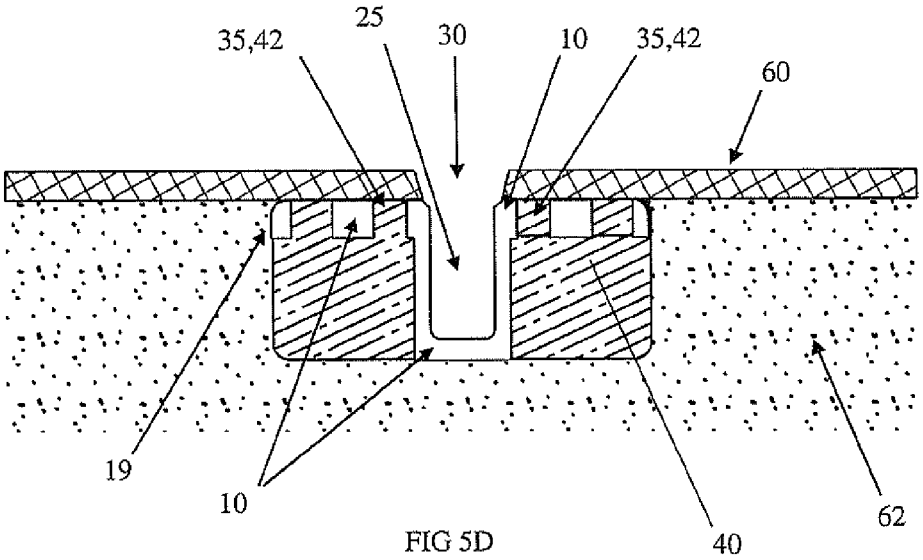
FIG. 5D is another transverse cross-sectional view of the fin plug assembly as shown in FIG. 5C, after the opening to the fin cavity has been restored.

FIG. 5A shows an example fin plug assembly 10 before installation into a surfcraft. FIGS. 5B, 5C and 5D show examples of the fin plug 10 once installed, with a glass layer 60 which can be a layer or coating of fiberglass matt or fibres with impregnating resin. In the plan view of FIG. 5B the cavity insert 50 is shown protecting the fin cavity 25 during the installation of the fin plug and application of the glass layers 60. FIG. 5C is a cross-sectional transverse view through a fin cavity 25 of an installed fin plug 10 where the glass layer 60 covers the whole of the fin plug 10. A masking tape 55 or a similar shaped sticker may be applied to the fin cavity 25 opening 30 before the application of the glass layer 60, as described below with respect to FIGS. 10A to 10H. Alternatively the cavity insert 50 may also be used. It will be appreciated that the holes 35 together with the foam 42 create a surface which can better adhere to the glass layer 60 as described below with respect to FIGS. 10A to 10H. FIG. 5D is another cross-sectional view of FIG. 5C showing an example of the fin plug 10 after a glass routing process to provide the opening 30 to the fin cavity 25. It will be appreciated that the process of installation and manufacture, as described herein can allow for: increased bonding to the foam compared with a surface of the fin plug, an increased surface area for the glass layer 60 to cover the top surface 15 of the fin plug 10 and a flat installation (where there is no or limited tenting 64 of the glass 60).

Figure 8:
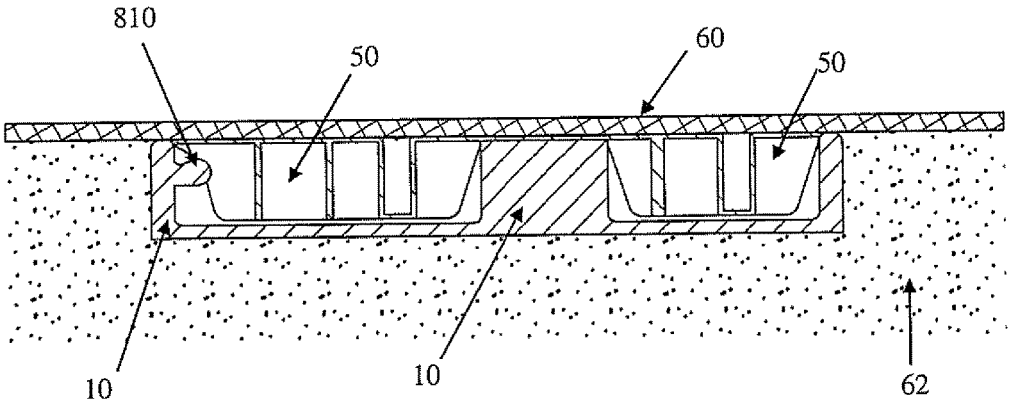
FIG. 8 is a cross-sectional longitudinal side view of FIG. 5C where alternatively the flush cavity insert of FIGS. 3A, 3B and 4A to 4H is inserted into the fin cavity.

FIG. 8 is a longitudinal, side cross-sectional view of FIG. 5C where alternatively the flush cavity insert 50 of FIGS. 3A, 3B and 4A to 4H is inserted into the fin cavity 25. A fin removal inhibiting means 810 is shown. The fin removal inhibiting means may include a ledge portion, within said fin cavity, adapted to overlie a section of the base element of said fin or to engage with a base element or tab of the fin.

Figure 9:
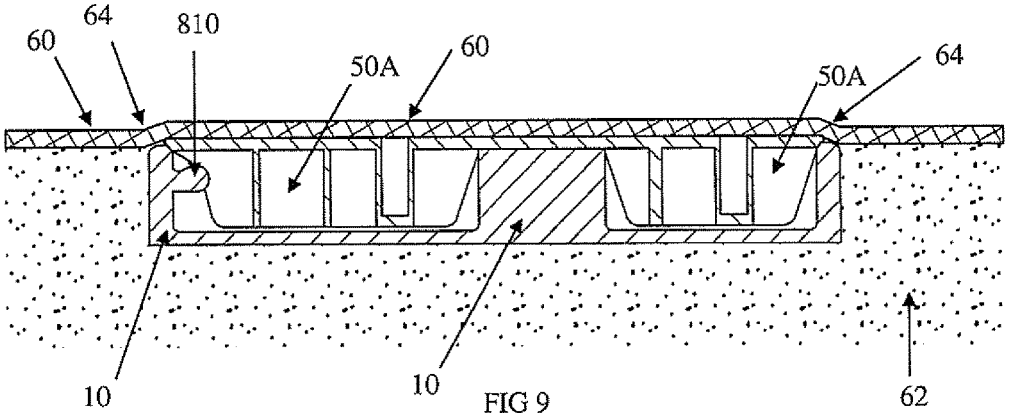
FIG. 9 is an alternate embodiment of FIG. 8 where a raised top cavity insert is inserted in the fin cavity.

FIG. 9 is an alternate embodiment of FIG. 8 where a raised top cavity insert 50A is inserted in the fin cavity 25. The raised top cavity insert 50A is not flush to the top surface 15 of the fin plug and accordingly causes a slight tenting 64 of the glass layer 60 over the raised top cavity insert 50A.

This may provide an advantage in indicating the position of the cavity insert 50A when removing the glass layer 60 from above the cavity insert 50A.

Notably, the fin plug 10 as described herein can include a ramp 70, lip, or the like formed at least partially or wholly around the surface of the cavity 25 opening 30. Examples of the ramp 70 are shown in FIGS. 10D, 11D, 11E and 12A. Thus, the ramp 70 includes a slightly raised surface from the top surface 15 of the fin plug 10. The ramp 70 forms a small ridge or raised lip about each fin cavity which helps to inhibit resinous material entering the cavity when the resin is poured or impregnated in the fiberglass matt to form the glass layer 60, in the manufacturing process.

Although FIGS. 10A to 10H show that the ramp 70 can be integrated with the fin plug 10, it will be appreciated that the fin plug 10 can also include a cap which forms the ramp or raised lip (that is, as a part of the cavity insert 50, 50A), and thus the fin plug 10 can include a flat top surface 15 with a cap or the raised top cavity insert 50A which forms the ramp 70. Alternatively, the top surface with the cap or the flush cavity insert 50 can be completely flat and the cavities are routed after the board has been glassed. Alternatively masking tape or a shaped blanking sticker/s may be applied to the opening 30 to prevent resinous material and other unwanted matter entering the fin cavity 25 during the water craft manufacture and fin plug installation.

Further examples of possible manufacturing and installation techniques of the fin plugs shown in the Figures are described below.

Figure 10A:
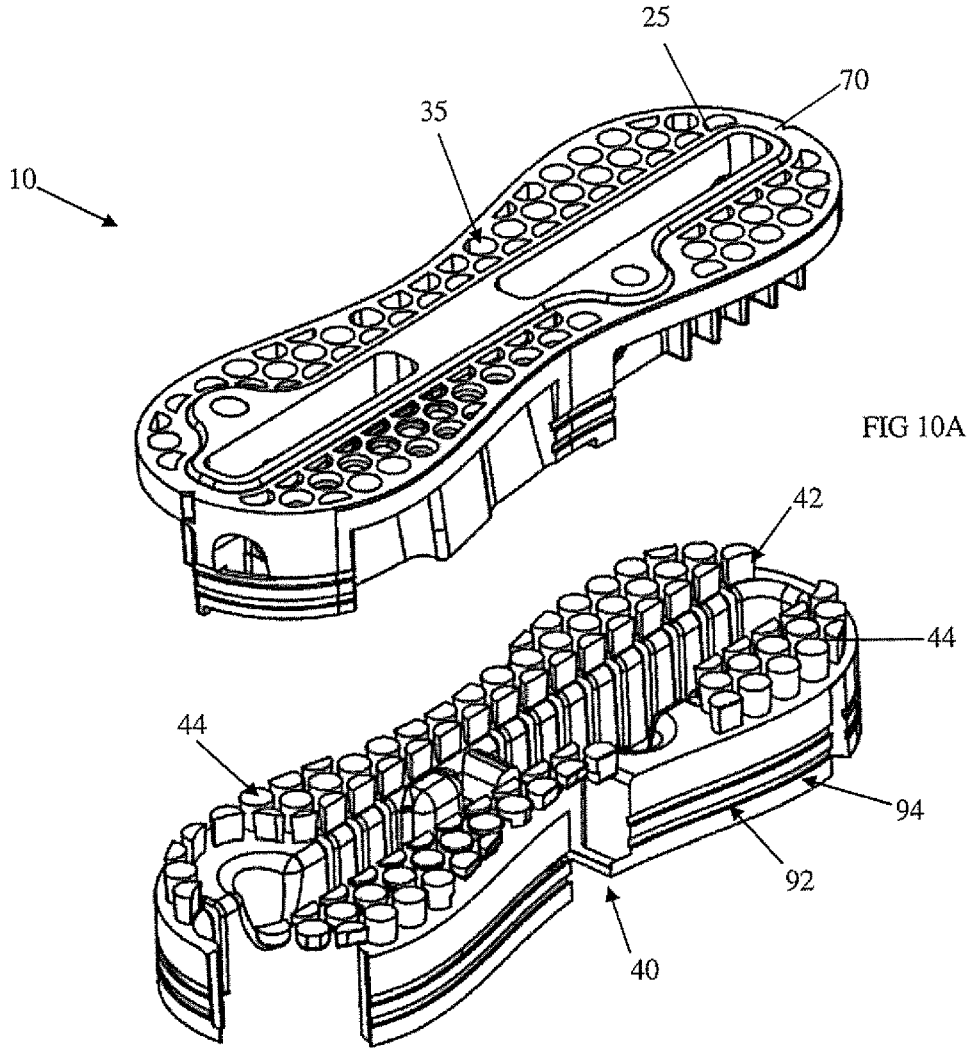
FIG. 10A is an exploded perspective view of another example composite foam and fin plug assembly according to an embodiment of the second aspect of this invention.

FIG. 10A is an exploded view of the fin plug assembly according to a preferred embodiment of the second aspect of this invention. This fin plug assembly includes the fin plug 10 and the foam body 40. As described above, the fin plug 10 includes a plurality of holes 35 extending between the top surface 15 and the bottom surface 22. As shown in FIG. 10A, the foam body includes a plurality of hole in-fills 42 or projections. These in-fills 42 are positioned in the corresponding holes 35 of the fin plug 10.

FIGS. 10B to 10H show examples of the composite fin plug assembly 90 including the fin plug 10 and the foam body 40, in which the foam in-fills 42 of the foam body 40 are located within corresponding holes 35 in the fin plug 10.

The fin plug assembly 90 is typically formed by inserting the fin plug 10 into a mould and liquid foam is injected into the mould so as to enable the foam to form and bond around the underside of the fin plug 10 and into the holes 35. The foam may then be heated to promote curing of the foam, thereby forming the composite foam and fin plug assembly 90. The foam body 40 is therefore, typically, moulded around the underside of the fin plug 10. Thus, as described herein, together the foam body 40 and the fin plug 10 form the composite foam and fin plug assembly 90 (as shown in FIGS. 10B to 10H).

Figure 10B:
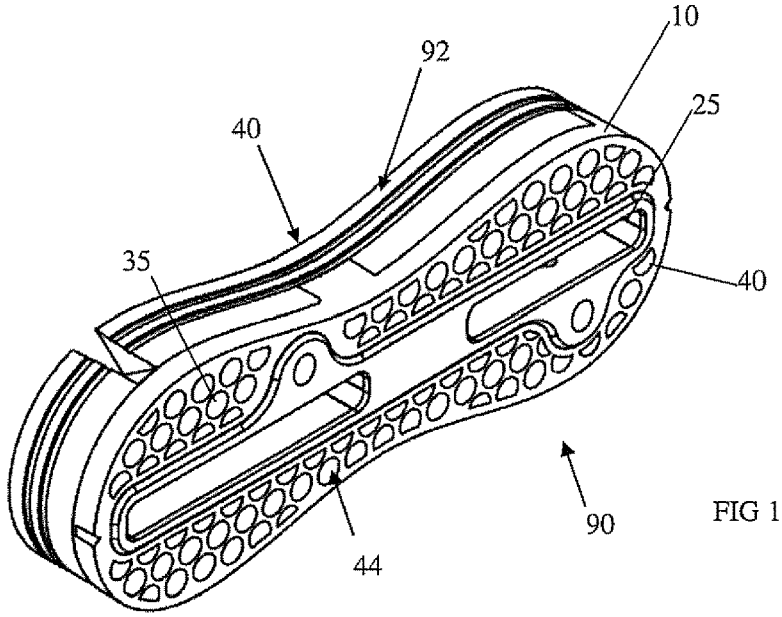
FIG. 10B is a front perspective view of the example fin plug assembly of FIG. 10A.
Figure 10C:
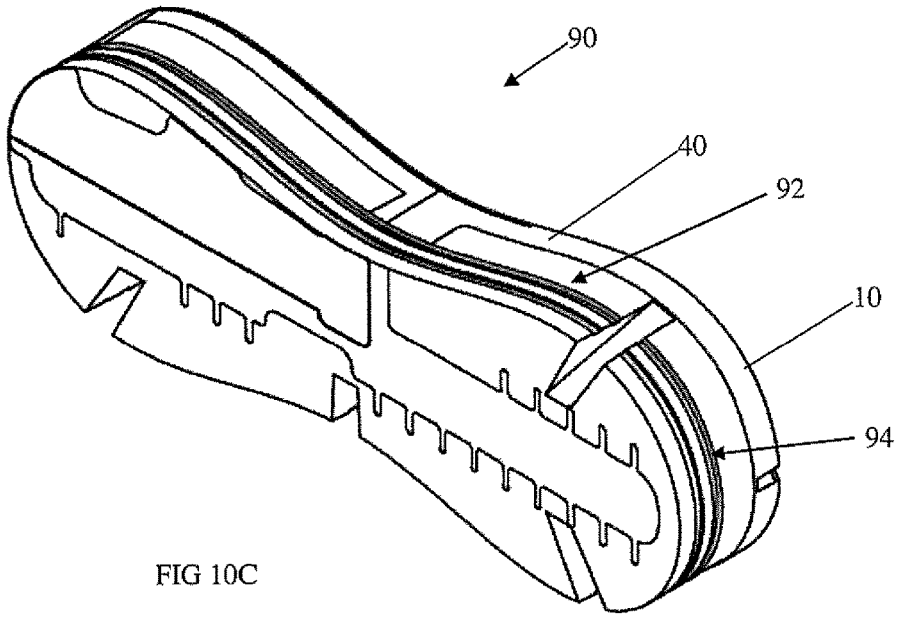
FIG. 10C is a back perspective view of the example fin plug assembly of FIG. 10A.
Figure 10D:
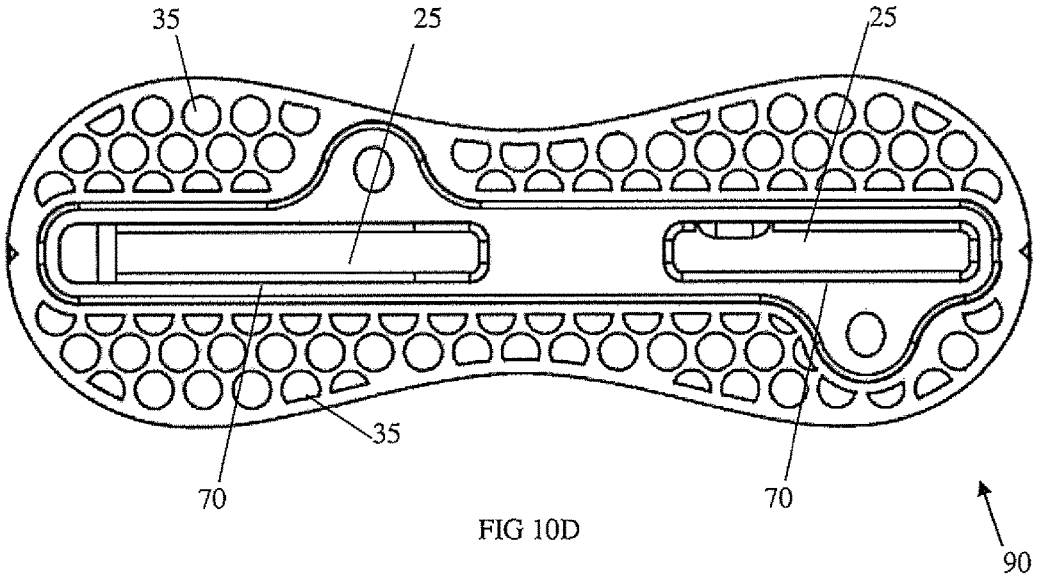
FIG. 10D is a top plan view of the example fin plug assembly of FIG. 10A.
Figure 10E:
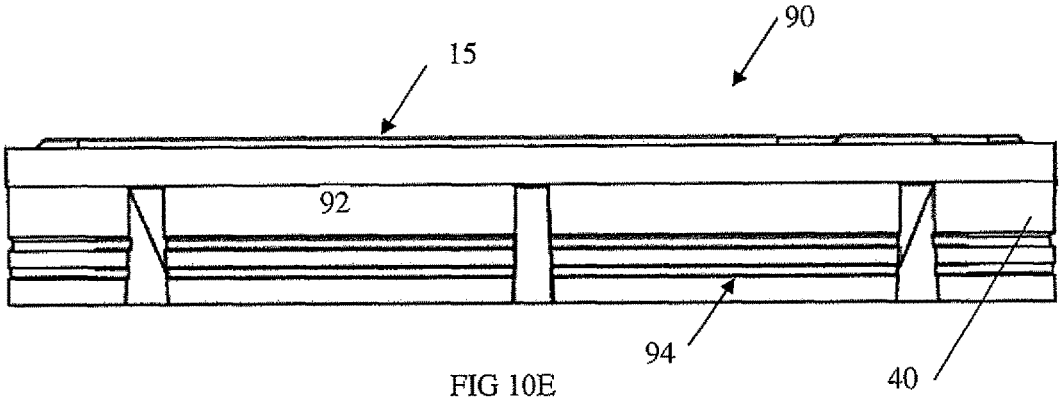
FIG. 10E is a side view of the example fin plug assembly of FIG. 10A.
Figure 10F:
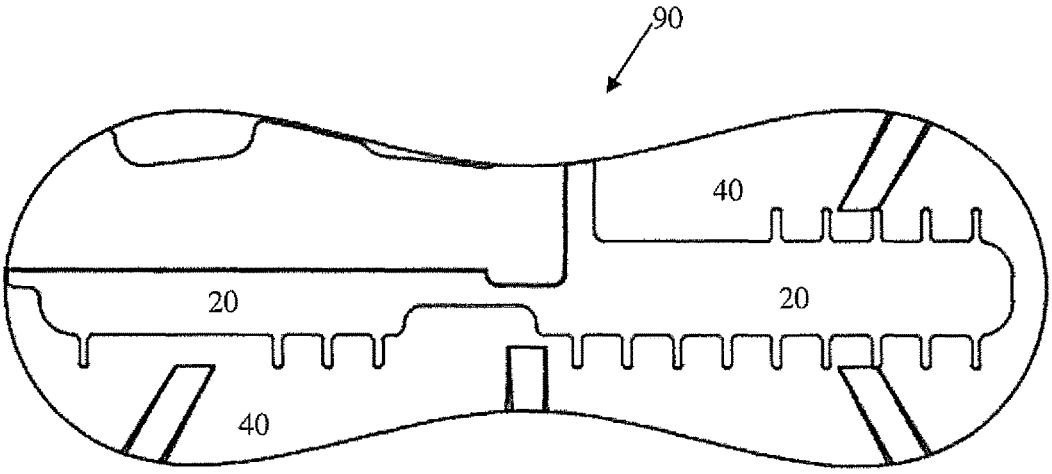
FIG. 10F is a bottom view of the example fin plug assembly of FIG. 10A.
Figure 10G:
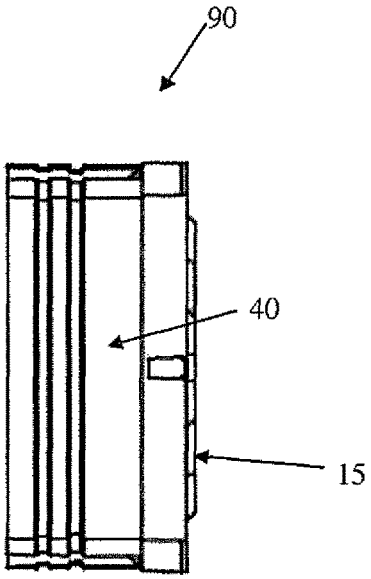
FIGS. 10G and 10H are front end and rear end views of the fin plug of FIG. 10A.
Figure 10H:
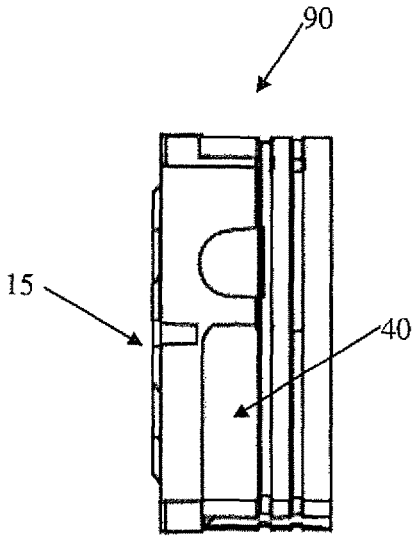
Figure 11A:
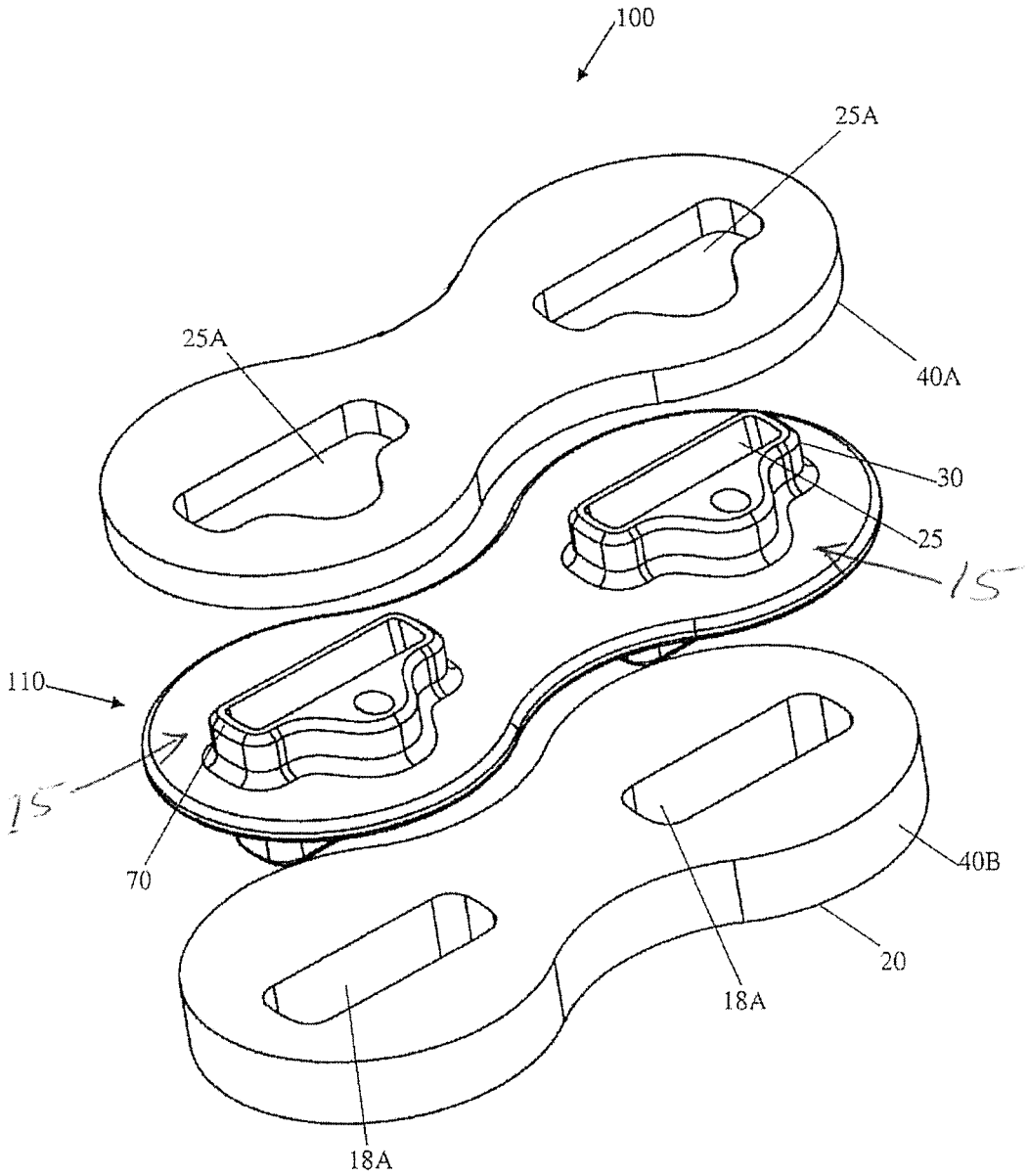
FIG. 11A is an exploded perspective view of yet another example fin plug assembly as described herein.
Figure 11B:
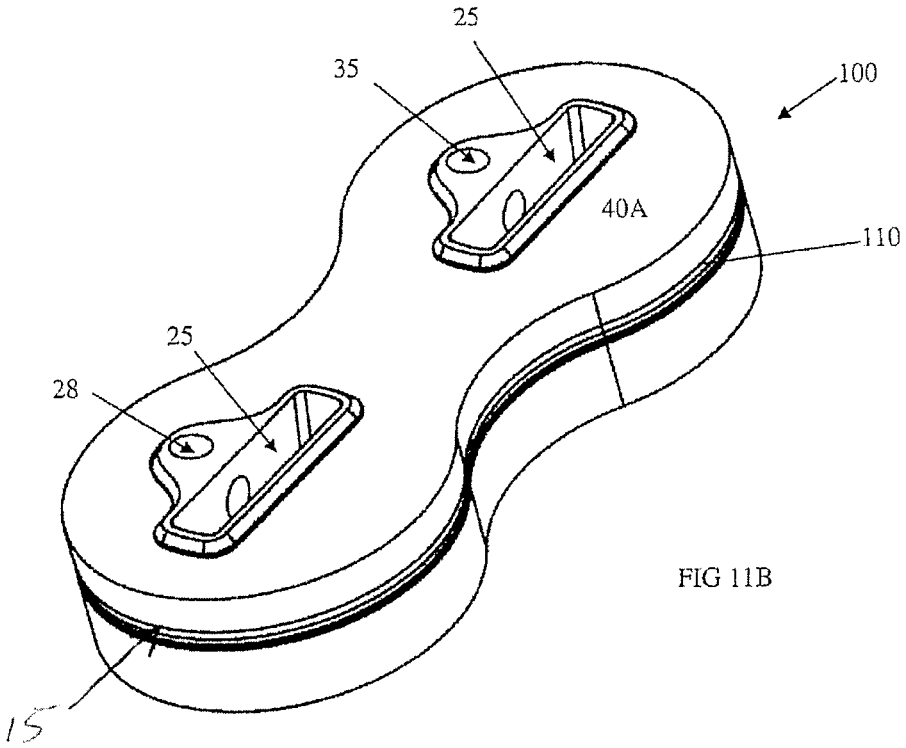
FIG. 11B is a top perspective view of the example fin plug assembly of FIG. 11A.
Figure 11C:
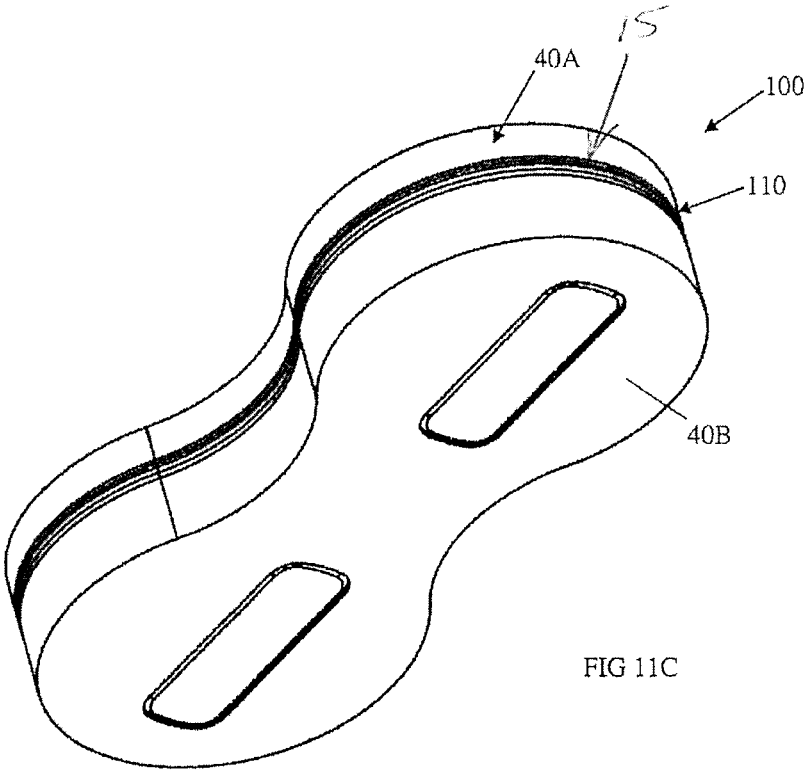
FIG. 11C is a bottom perspective view of the example fin plug assembly of FIG. 11A.
Figure 11D:
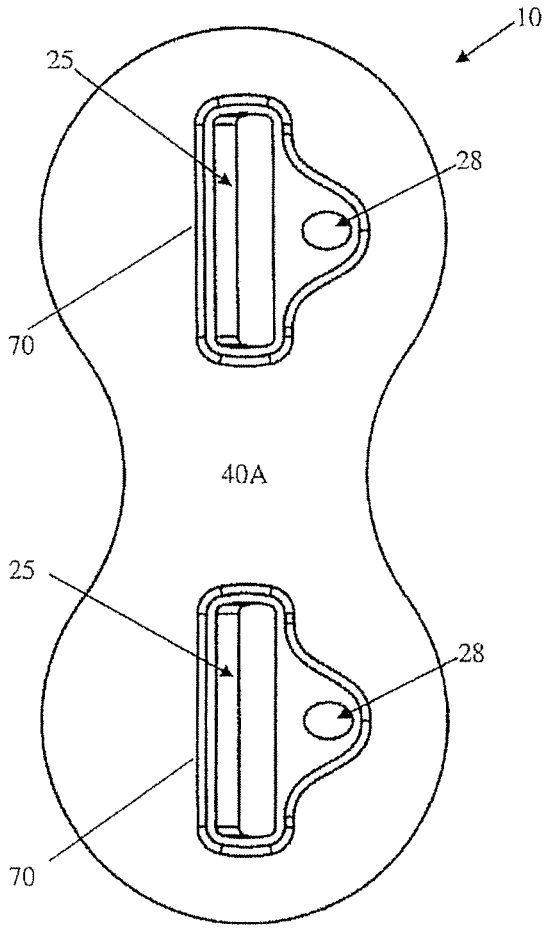
FIG. 11D is top plan view of the example fin plug assembly of FIG. 11A.
Figure 11E:
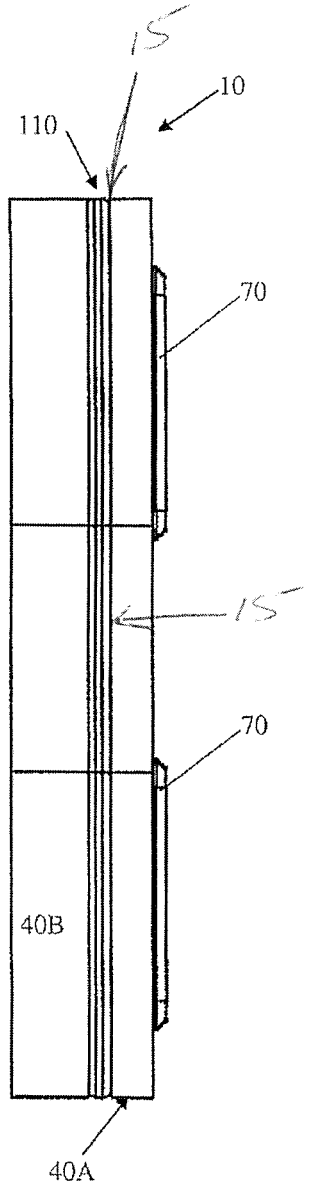
FIG. 11E is a side view of the example fin plug assembly of FIG. 11A.
Figure 11F:
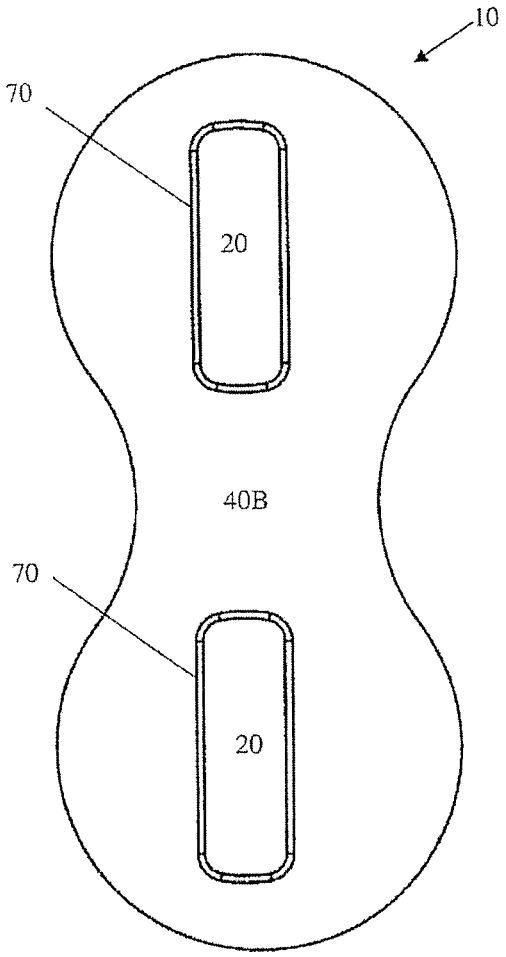
FIG. 11F is a bottom view of the example fin plug assembly of FIG. 11A.
Figure 11G:
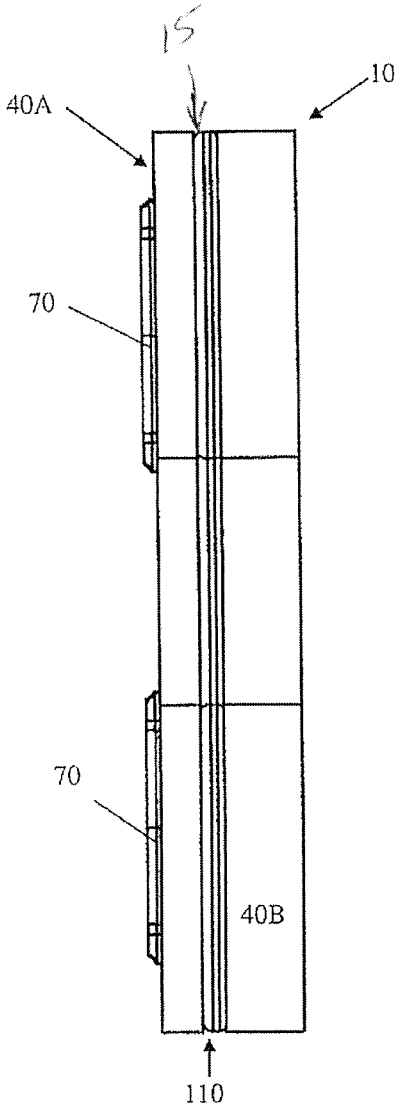
FIG. 11G is a side view of the example fin plug assembly of FIG. 11A.
Figure 11H:
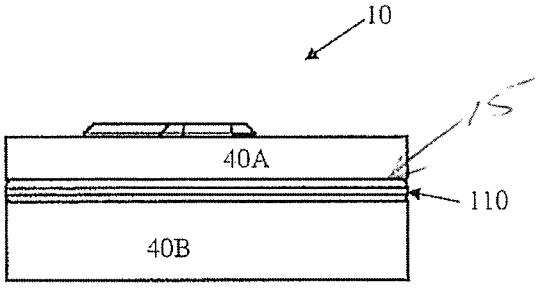
FIG. 11H is a front end view of the example fin plug assembly of FIG. 11A.
Figure 12A:
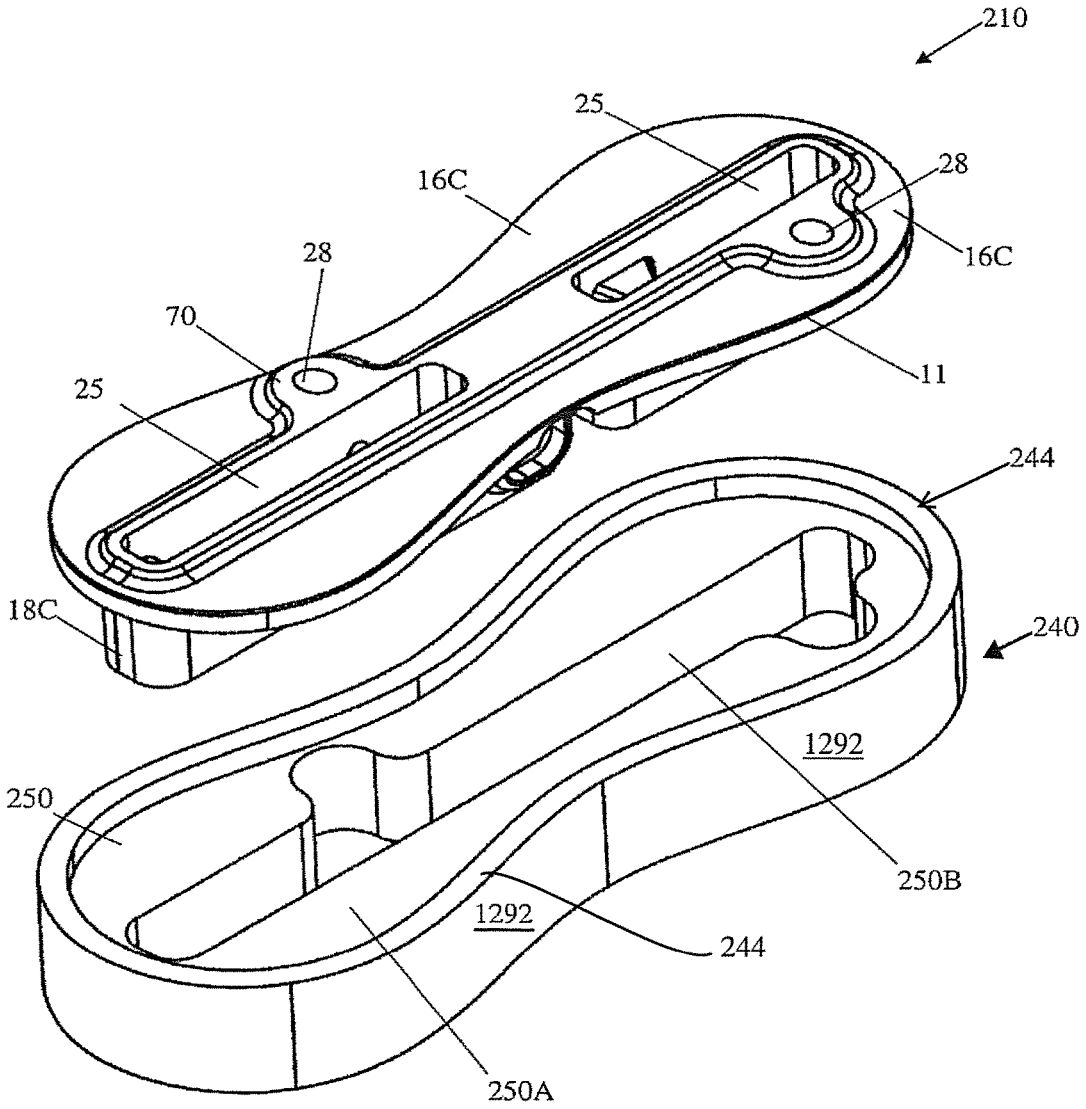
FIG. 12A is an exploded perspective view of another example fin plug assembly as described herein.
Figure 12B:
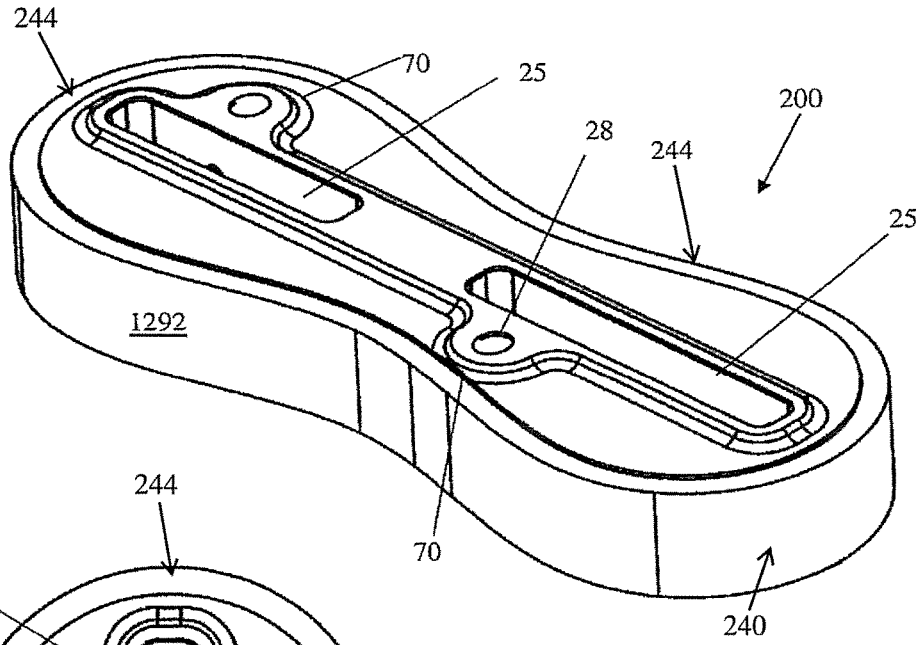
FIG. 12B is a top perspective view of the example fin plug assembly of FIG. 12A.
Figure 12C:
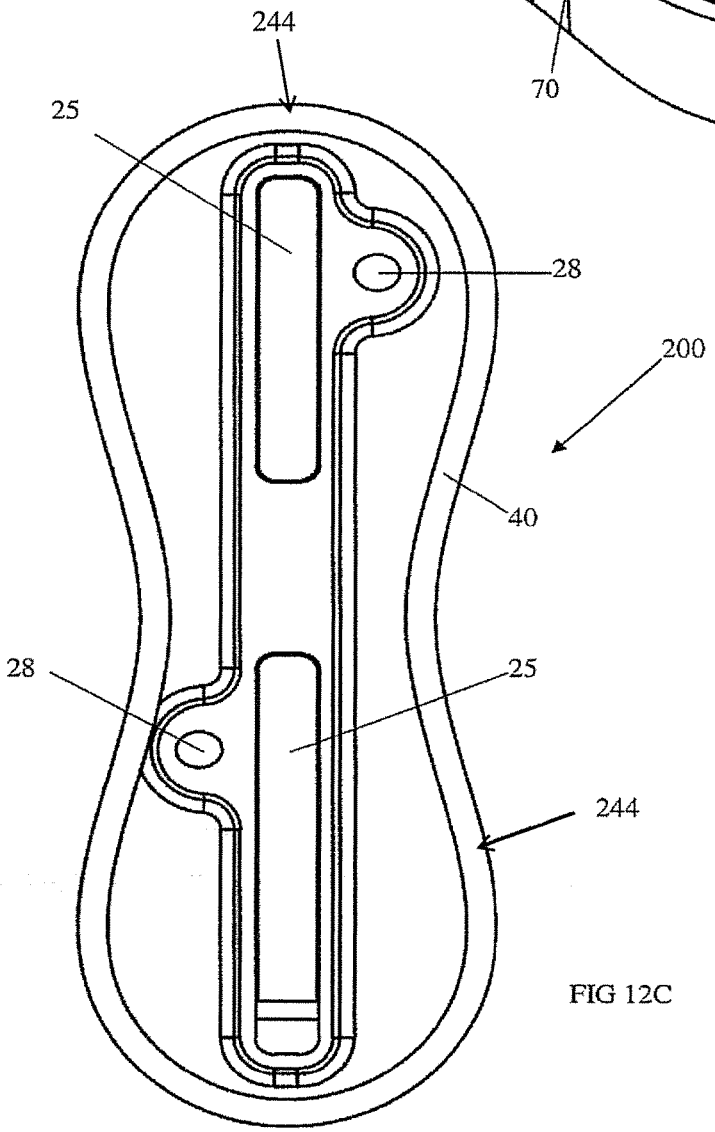
FIG. 12C is a top plan view of the example fin plug assembly of FIG. 12A.
Figure 12D:
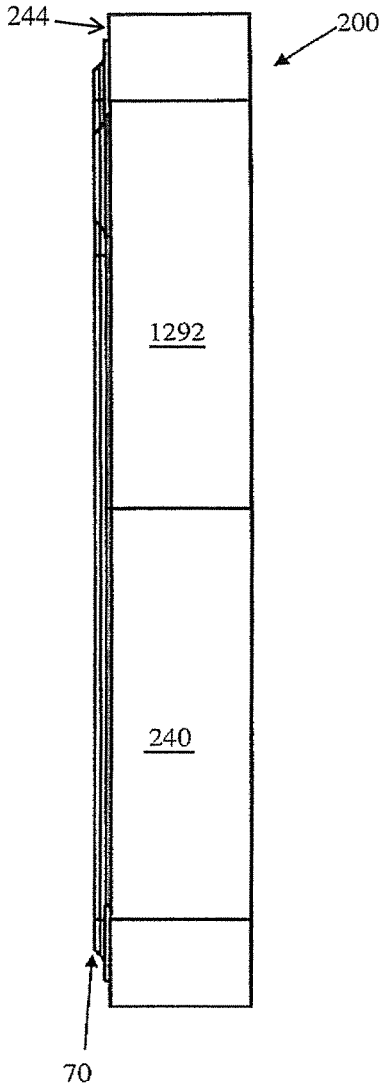
FIGS. 12D and 12F are side views of the example fin plug assembly of FIG. 12A.
Figure 12E:
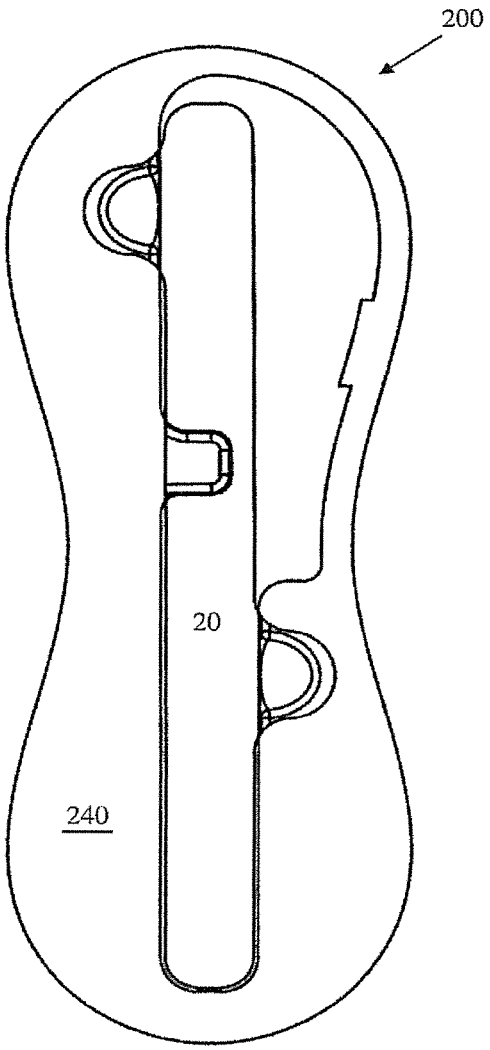
FIG. 12E is a bottom view of the example fin plug assembly of FIG. 12A.
Figure 12F:
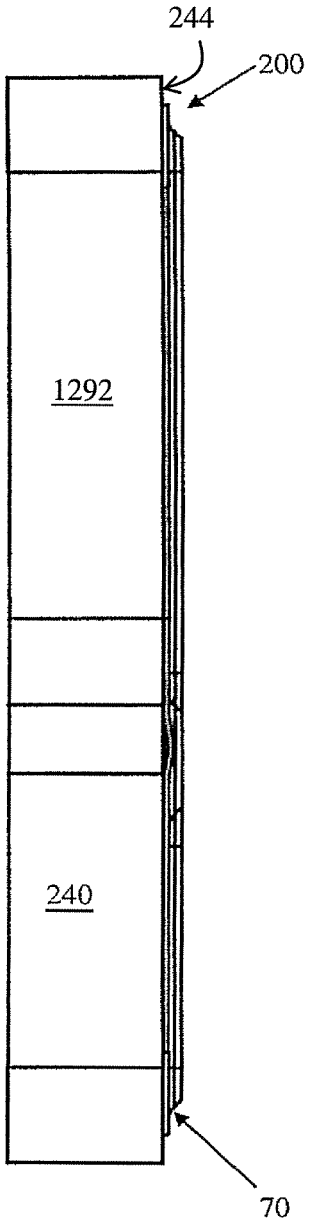
Figure 12G:
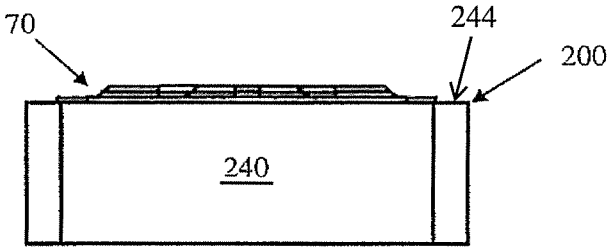
FIG. 12G is a front end view of the example fin plug of FIG. 12A.

The foam in-fills 42 occupy the holes 35 and, as shown in FIGS. 10B and 10D, a top end 44 of the foam in-fills 42 may be substantially flush with the top surface 15 of the fin plug 10 in order to effectively bond with glass layer 60. FIGS. 5C and 5D provide a cross-sectional view of the flange 19 with holes 35 and foam in-fills 42 bonding with the glass layer 60. The exposed top ends 44 of the foam in-fills result in improved adhesion with resinous material which is subsequently placed over the fin plug assembly 90. This is because resinous material generally forms a stronger chemical and mechanical bond with foam than with the hard plastic-type material typically used for a fin plug. The resinous material also may penetrate, in part at least, the foam in-fills 42 within the holes 35 so as to provide further mechanical keying to the applied glass layer 60. The glass layer 60 applied to the composite fin plug assembly is shown in FIGS. 5B, 5C, 5D, 8 and 9. Accordingly the top surface 15 and flange 19 of the fin plug 10 is additionally bonded and additionally mechanically connected to the rest of the water craft body by the glass layer 60.

It will be readily appreciated that the foam 42 within the holes 35 may not entirely fill the holes 35 to be flush with the top surface 15, but may be a sufficient filling of the hole to allow sufficient bonding with the glass layer 60. The glass layer 60 may also partially enter the holes 35. Alternatively it will also be appreciated that the foam infills 42 may also overfill the holes 35 such that foam 42 protrudes above the top surface 15. For example the foam infill 42 may protrude up to approximately 3 mm above the top surface 15 or more preferably up to approximately 1 mm above the top surface 15.

It will also be readily appreciated that the geometry or shape of the holes 35 with the foam in-fills 42 may be varied and still achieve the desired bonding and mechanical connection between the fin plug 10, the glass layer 60 and the rest of the body of the water craft. The shape, arrangement and number of the holes may be optimised and varied to improve the desired bonding and mechanical connections between the fin cavities and the glass layer 60, whilst maintaining the structural integrity of the planar portion 16 and the flange 19. For example the hole cross-sectional shape may be as shown in the Figures as: circular, semi-circular, portions of a circle and hexagonal. Further cross-sectional shapes include: slots, ellipses, rectangular, square, irregular shapes, polygonal and the like to provide the function required for providing a foam surface for bonding with the glass layer 60. (The at least one recess or aperture in the top surface filled with foam forms a surface for bonding.) Alternatively the planar portion 16 and the flange 19 may in part at least be a lattice of holes or apertures where the holes or the apertures may be of different shapes depending on: a form of the lattice or a framework which forms the lattice.

The top surface 15 may alternatively be rippled or corrugated. The wells formed by the rippled surface or corrugations may contain foam for bonding with the glass layer 60.

It will also be further appreciated that a use of a second moulding process, described in detail below, may be used to apply the foam to holes which are blind. For example the holes are only open at one end at the top surface 15. In other words the holes or apertures may only extend part of a thickness of the flange 19 or of the planar portion 16. Alternatively blind holes may also include recesses in the top surface of the fin plug. FIGS. 19A to 20B show blind holes 1935 in the planar portion 16 and flange 19 of the fin plug. The corresponding foam body 1940, 2040 has foam inflls 1942 for the blind holes which are shown as free standing to the foam bodies in FIGS. 19A and 20A. If the foam body is preformed, that is not injection moulded about the fin plug, then the foam infills 1942 for the blind holes may be supplied also as preformed foam infills 1942.

As can be seen from the FIGS. 10D to 10H, the fin plug assembly 90 has exposed foam surfaces at the top and at the bottom of the assembly as well as around the sidewall(s) 92 of corresponding to the foam body 40. These exposed foam surfaces of the bottom and sidewalls 92 of the composite fin plug assembly 90 enhance the ability of the fin plug assembly to bond with resinous material, which is typically applied about the fin plug assembly 90 when it is being installed in a surf craft. Example installation procedures are described in detail further below.

The foam used to form the foam body or foam infill 40 may be the same or substantially similar or compatible with that used for the foam used for foam blanks 62 of surfboards and water crafts. For example closed cell polyurethane (PU) closed cell expanded polystyrene (EPS) and closed cell extruded polystyrene foams. The density of such foams may approximately range from 15 to 50 kg/m$^3$.

In an alternate embodiment the foam body or foam infill 40 may be a higher strength and a higher stiffness closed foam that than that used for the foam blank of the water craft or the surf craft. Such higher strength or higher stiffness foams typically correspond to higher density foams compared with those used for water craft and surfboard blanks. For example a foam density of greater than approximately 50 kg/m$^3$ may be used or more preferably greater than approximately 70 kg/m$^3$.

The higher density foam may be of the same or similar type as that described above for the foam blanks as well as including epoxy foams, polyethylene terephthalate (PET) foams and polyvinyl chloride (PVC) foams. It will be readily appreciated that a person skilled in the art may select or design a suitable performing foam.

A higher density foam for the foam body or foam infill compared with the foam blank may provide a number of advantages in the performance of the composite foam and fin plug assembly within the water craft or surf craft. For example a stiffer or higher strength foam within the holes 35 of the top surface may more effectively transmit and withstand higher forces in the bonding between the glass layer 60 and the composite foam and fin plug assembly. With respect to the sidewalls and bottom of the foam body of foam infill 40 the advantages are as disclosed in PCT Patent Application No. PCT/AU2008/001132, "A Fin Plug Assembly and Method of Installation" filed 5 Aug. 2008, the contents of which are incorporated herein by reference.

Figure 19A:
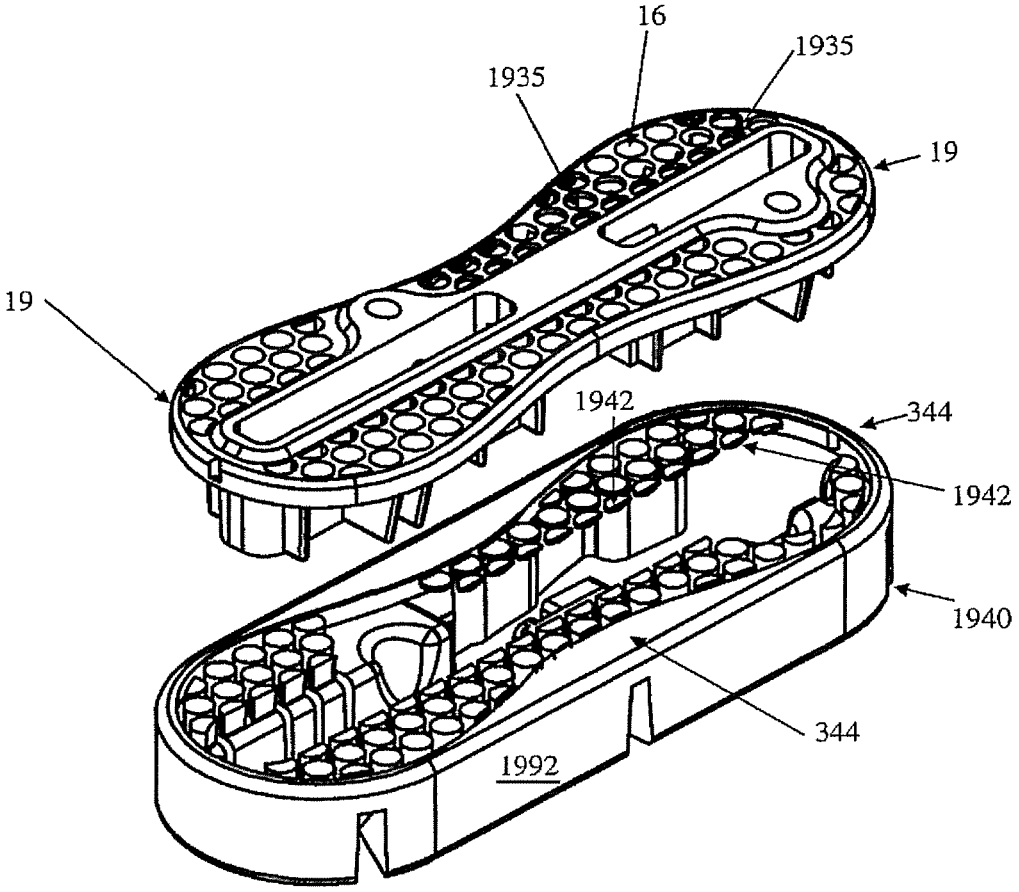
FIGS. 19A and 19B are respective exploded and assembled perspective views of a composite foam fin plug with a straight side wall and a peripheral ridge about the fin plug flange.
Figure 19B:
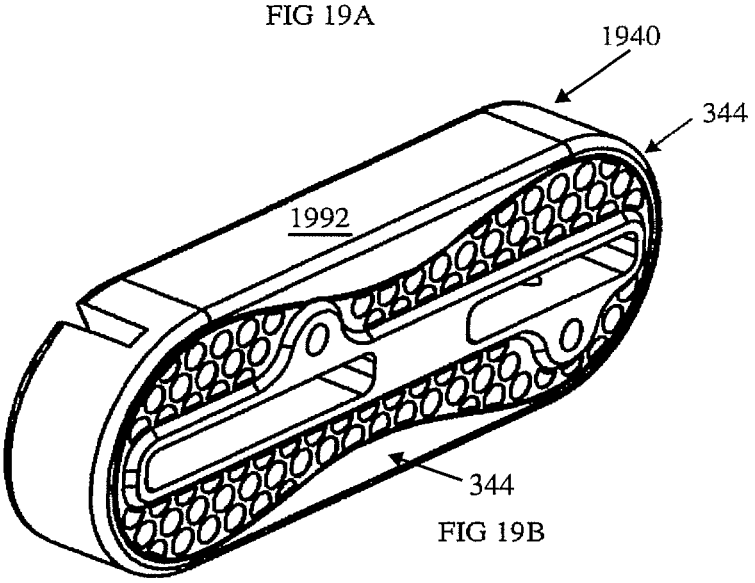
Figure 20A:
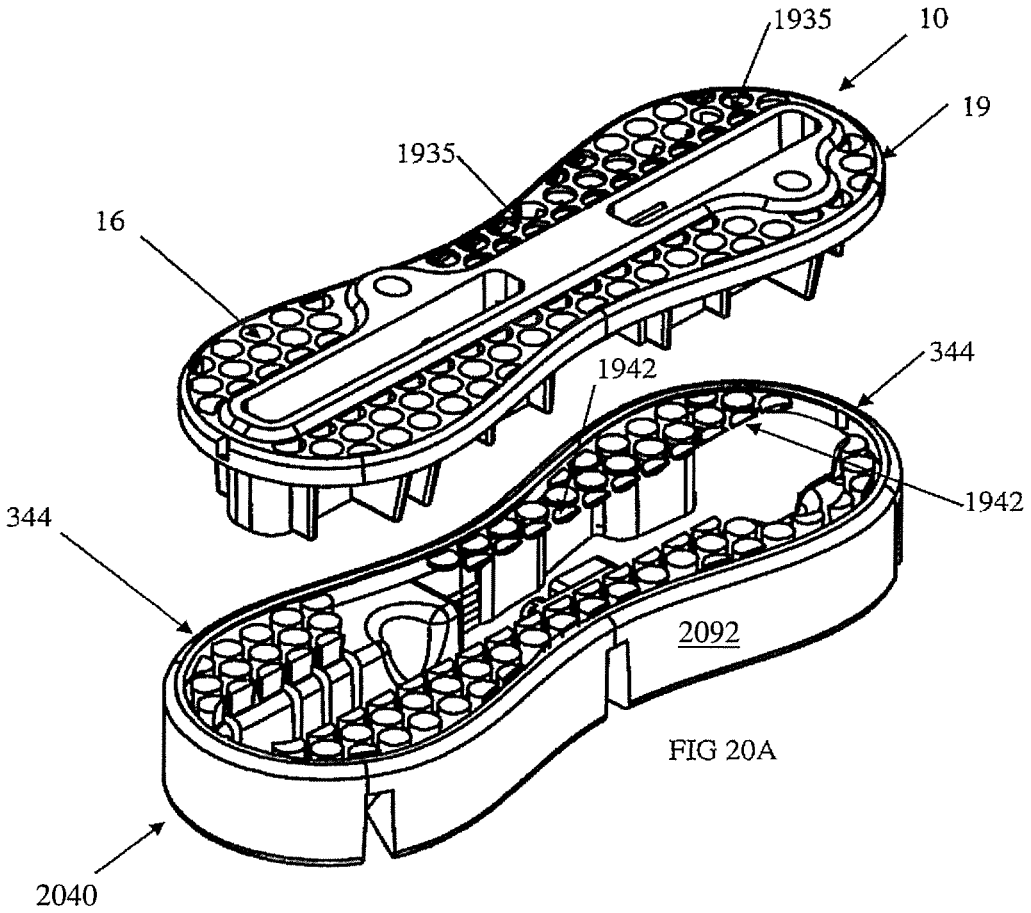
FIGS. 20A and 20B are an alternate embodiment of FIGS. 19A and 19B, without the straight side wall of the foam body.
Figure 20B:
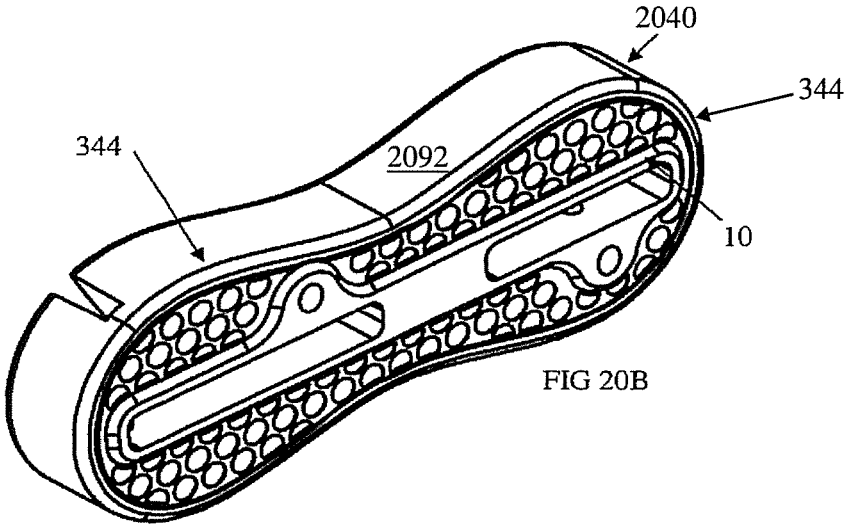

The profile of the sidewalls 92 of the foam body 40 are shown in FIGS. 10A to 10H as being substantially the same as the external perimeter 22 of the flange 19 of the fin plug 10. It will be readily appreciated that the profile of the sidewalls 92 may also be convex, serrated (sawtooth), corrugated, undercut or otherwise recessed 94 to improve the function of the side wall and the interaction of the sidewall with the foam blank. FIGS. 19A and 19B show a foam body 1940 with a straight side wall 1992.

FIGS. 11A to 11H show an alternative composite fin plug assembly 100, in which the fin plug 110 includes first foam section 40A or layer and a second foam section 40B or layer. Thus, in this particular example, a rigid (e.g. plastic) fin plug 110 is sandwiched and adhered between, or encapsulated by, foam sections 40A and 40B. The first foam section 40A has holes 25A there through which align with the fin cavities 25 of the fin plug 110. The second foam section 40B has recesses 18A adapted to receive base portions 18A of the fin plug 110. The fin plug 110 may be adhered to the foam sections 40A and 40B by means of a resinous material (or any other suitable adhesive material).

As can be seen from the FIGS. 11A to 11H, the fin plug assembly 100 has exposed foam surfaces at the top and at the bottom of the assembly as well as around the sidewall(s) of it. These exposed foam surfaces enhance the ability of the fin plug assembly to bond with resinous material, which is typically located about the fin plug assembly 100 when it is being installed in a surf craft. As described for FIGS. 10 to 10D, the glass layer 60 bonds and mechanically connects the rest of the water craft body to the first foam section 40A, with the fin plug 110 top surface. (The foam layer forms a surface for bonding with an overlying glass layer.)

Alternatively the foam sections 40A, 40B may be injection moulded about the fin plug 110 as described above for FIGS. 10A to 10H. It will be appreciated that the fin plug assembly 100 shown in FIGS. 11A to 11H can be achieved by forming foam around the fin plug 110 (e.g. in a mould) or by bonding suitably two pre-cut pieces of foam to the fin plug 10. It will also be appreciated that the first foam section 40A may have additional holes, slots or a connected arrangement of recesses (not shown) to further improve the bonding and the mechanical keying of the glass layer 60 to the alternative fin plug assembly 100.

FIGS. 12A to 12G show a further alternative composite fin plug assembly 200, having a fin plug 210 and a foam body 240. The foam body 240 has a plug cavity 250 adapted to receive the fin plug 210. As can be seen from FIG. 12A, the plug cavity includes a shallow cavity 250A, for receiving a planar portion 16C of the fin plug 210, and a deeper cavity 250B, for receiving a base portion 18C in which the fin plug 210. The fin plug 210 is positioned in the foam body 240 such that the foam body forms a wall of foam 1292 or a peripheral ridge 244 around the planar portion 16C fin plug 210. The fin plug 210 may be adhered to the foam body 240 by means of a resinous material (or any other suitable adhesive material). As can be seen from the FIGS. 12A to 12G, the fin plug assembly 200 has exposed foam surfaces at the top 244 of the foam wall 1292 and at the bottom of the assembly as well as around the sidewall(s) 1292 of the foam body 240. These exposed foam surfaces and the peripheral ridge 244 enhances the ability of the fin plug assembly to bond with resinous material, which is typically located about the fin plug assembly 200 when it is being installed in a surf craft.

It will be readily appreciated that an alternative first foam section 40A may also be applied to the top surface of the planar portion 16C of the fin plug 210 in FIGS. 12A to 12G. An alternative first foam section or layer to the fin plug 210 may further improve the bonding and mechanical connection between the fin plug 210, the glass layer 60 and the rest of the body of the water craft or surf craft.

FIGS. 19A, 19B, 20A and 20B show a peripheral ridge 344 of foam as an extension of the sidewall 2092, 1992. The peripheral ridge 344 forms a wall of foam about the planar portion 16 of the flange 19 of the fin plug 10. The peripheral ridge 344 will also bond and mechanically connect with the glass layer 60 to further improve transmission of forces between the fin, fin plug 10 and the body of the water craft or surf craft.

Figure 13A:
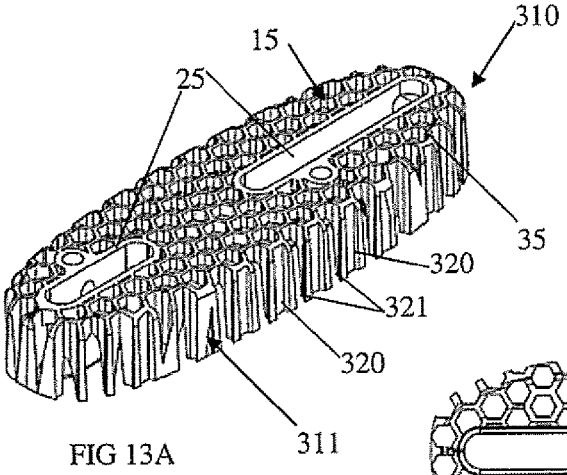
FIGS. 13A to 13G show a further example of a fin plug according to an alternative embodiment of the first aspect of this invention. In particular.
Figure 13B:
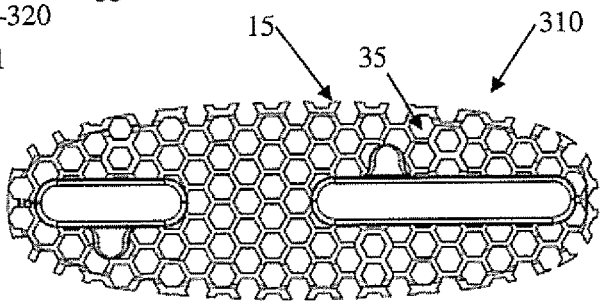
Figures 13C, 13D, 13E:
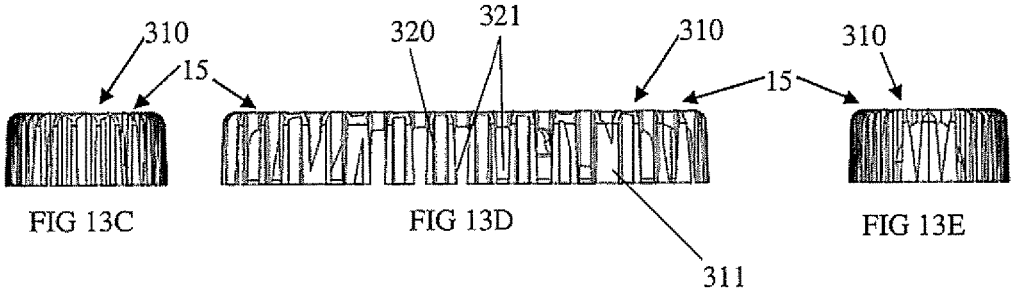
Figure 13F:
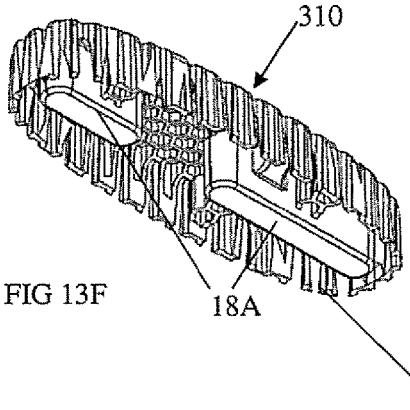
Figure 13G:
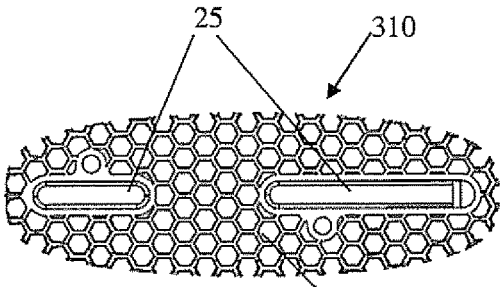
Figure 14A:
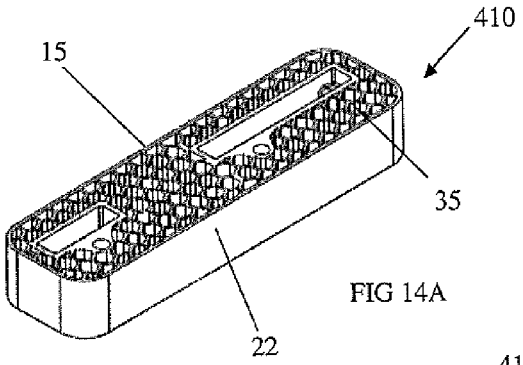
FIGS. 14A to 14G show yet a further example of another fin plug according to another alternative embodiment of the first aspect of this invention. In particular.
Figure 14B:
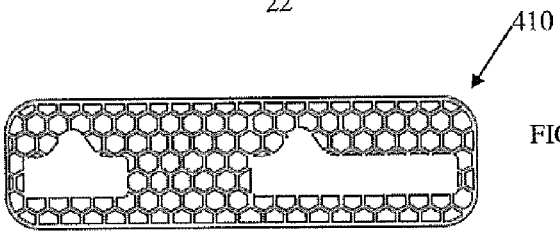
Figure 14C:
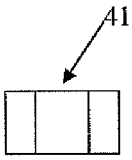
Figure 14D:
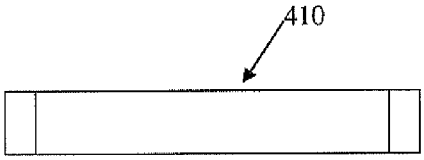
Figure 14E:
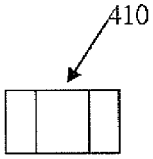
Figure 14F:
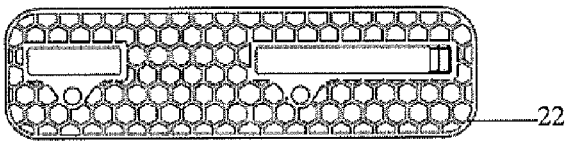
Figure 14G:
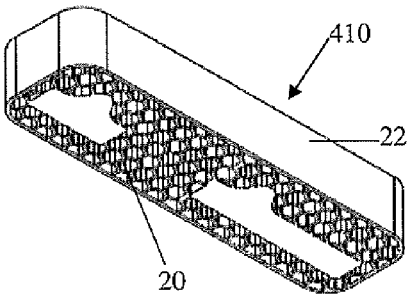
Figure 15A:
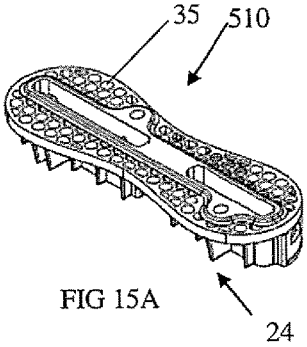
FIG. 15A to 15J show yet another example of another fin plug according to another alternative embodiment of the first aspect of this invention. In particular.
Figure 15B:
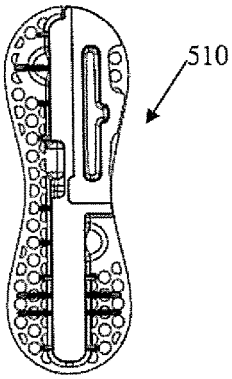
Figure 15C:
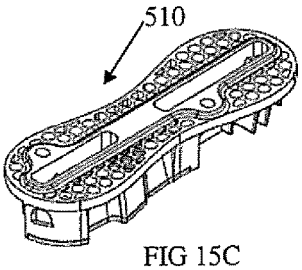
Figure 15D:
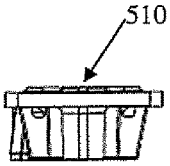
Figure 15E:
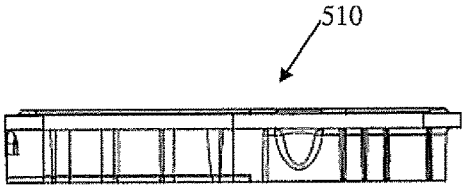
Figure 15F:
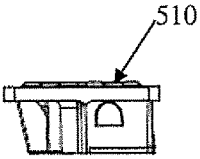
Figure 15G:
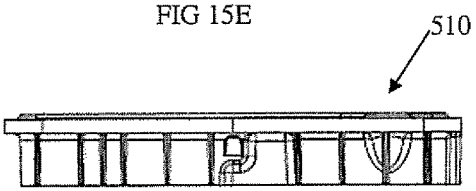
Figure 15H:
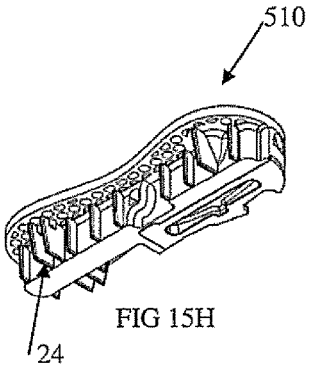
Figure 15I:
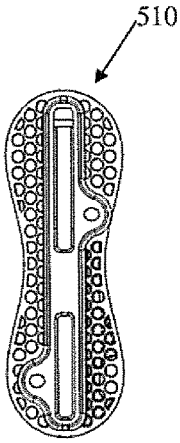
Figure 15J:
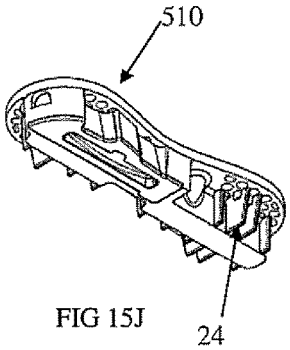

FIGS. 13A to 13G show another example of a fin plug 310. In this particular example, the holes 35 form a honeycomb like structure when the fin plug 310 is viewed from above (as in FIG. 13B, for example). Further, this particular example has a skirting 311 which forms around the external perimeter 22 of the fin plug 310. The skirting comprises a plurality of skirting elements 320 and a plurality of voids 321 between the skirting elements. As can be seen, the skirting 311 extends from the top surface 15 down at a length which is similar to the length of the cavities 25 within the base portion 18A (for securing the fins of a surf craft). It will be appreciated that in this particular example, when filled with the foam, the foam can fill in the voids 321 between the skirting elements 320. Once filled, the outer perimeter 22 may have a rough surface of plastic skirting elements 320 and foam (in the adjoining voids). In addition the foam may also fill in the holes of the honeycomb like structure about the fin cavities 25. The foam may also extend below the honeycomb structure into the volume bounded by the skirting 311 and the base portion 18A, as shown in FIG. 13F. An alternative composite foam and fin plug assembly 310 can then be formed.

In yet a further example, FIGS. 14A to 14G show an example of a fin plug 410, having a plurality of holes 35, in which the fin plug has a solid border or perimeter 22. In this particular example, when the holes 35 of the fin plug 410 are filled with foam, the foam is only visible on the top surface 15 and the bottom surface 20 of the composite foam and fin plug assembly.

Figure 16A:
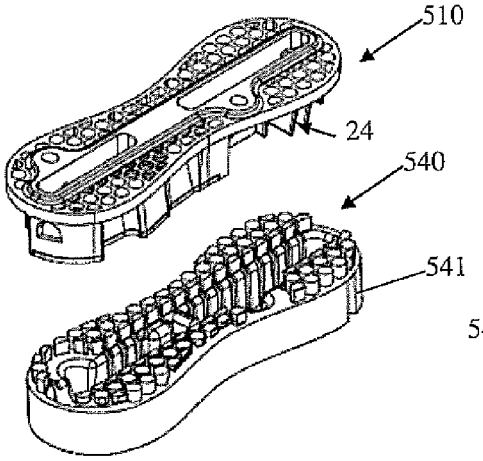
FIG. 16A is an exploded perspective view of another example of the fin plug assembly according to an alternative embodiment of FIGS. 10A and 10B.
Figure 16B:
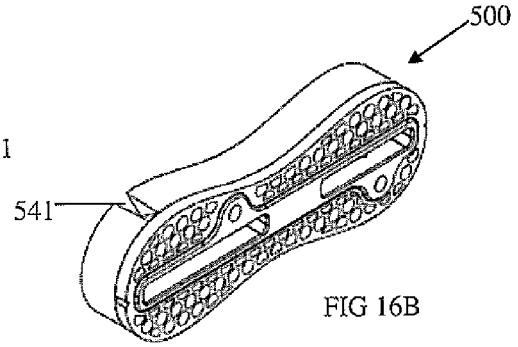
FIGS. 16B to 16H show the example fin plug assembly of FIG. 16A, once formed. In particular.
Figure 16D:
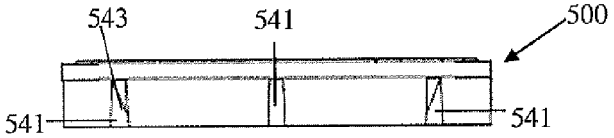
Figure 16C:
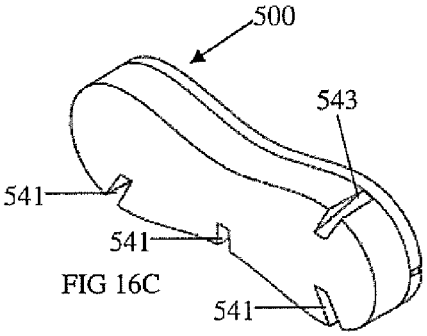
Figure 16E:
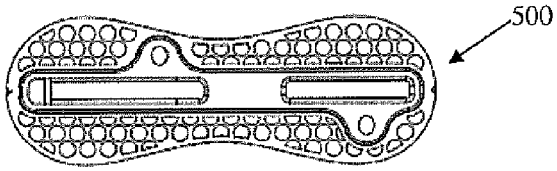
Figure 16F:
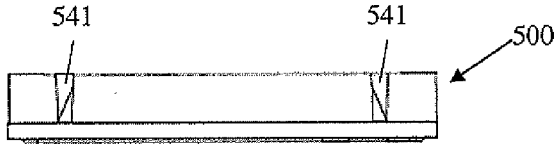
Figure 16G:
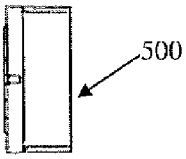
Figure 16H:
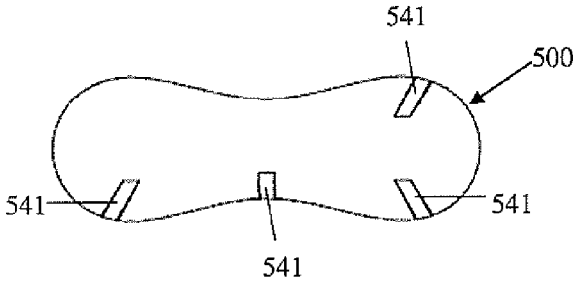
Figure 17A:
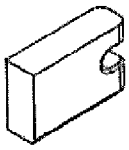
FIG. 17A is a rear perspective view of an example cavity insert.
Figure 17B:
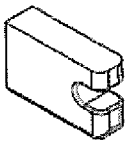
FIG. 17B is a front perspective view.
Figure 17C:
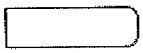
FIG. 17C is a bottom view.
Figure 17D:
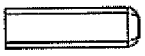
FIG. 17D is a plan view.
Figure 17E:
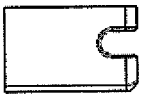
FIG. 17E is a left side view.
Figure 17F:
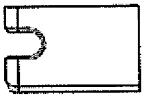
FIG. 17F is a right side view.
Figure 17G:
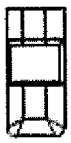
FIG. 17G is an end view of the example cavity insert of FIG. 17A. Further.
Figure 18A:
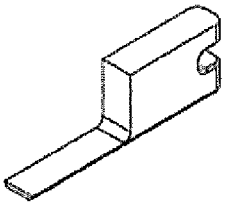
FIG. 18A is a back perspective view of an example cavity insert with a tag.
Figure 18B:
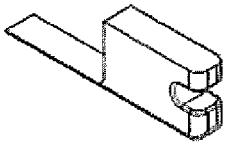
FIG. 18B is an example front perspective view.
Figure 18C:
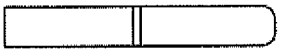
FIG. 18C is a plan view.
Figure 18D:
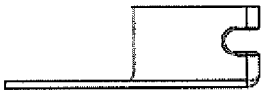
FIG. 18D is a left side view.
Figure 18F:
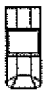
FIG. 18F is an end view.
Figure 18E:
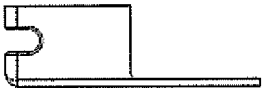
FIG. 18E is a right side view.
Figure 18G:
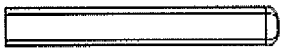
FIG. 18G is a bottom view of the example cavity insert of FIG. 18A.

FIGS. 15A to 15J and FIGS. 16A to 16H are other embodiments of FIGS. 10A to 10H. FIGS. 15A to 15J and FIGS. 16A to 16H show further examples of a fin plug 510 having a plurality of holes 35. In this particular example, the holes of the fin plug 510 are configured to be filled with the foam 540 as shown in FIG. 16A. FIGS. 16B to 16H show an example of a fin plug assembly 500 formed when the foam fills the holes of the fin plug 510 forming a foam body 540.

In the example of FIGS. 16A to 16H, the foam body 540 includes one or more channels 541 in a sidewall thereof. The channels 541 are moulded into the foam body 540 such that when the fin plug assembly 500 is inserted into the surf craft, any extra resin may flow upwards and outwards through the channels 541 and can be directed away from the surface of the foam blank. It will further be appreciated that the one or more channels 541 are formed to make it easier for the assembly 500 to be inserted into the surf craft as the space in the channels 541 forms a void for excess resin when the fin plug assembly 500 is inserted. As shown in the examples, the channels 541 can include a ramped portion 543.

First Example Manufacturing Technique of the Composite Foam and Fin Plug Assembly in FIGS. 1A to 1B, 2A to 2H, 3A and 3B, 4A to 4H, 10A to 10H, 13A to 13G, 14A to 14G, 19A with 19B and 20A with 20B.

Steps which may be taken in a manufacturing of the fin plug of the above Figures includes:

1) Form the fin plug by use of injection moulding the fin plug in a rigid thermoplastic.
2) Assemble components for the tool-less mechanism application of the biasing means 45, as referenced earlier PCT/AU2013/000738.
3) Use injection moulding to form the cavity insert out of a rigid thermoplastic.
4) Snap fit the cavity insert into the fin plug
5) Insert the fin plug with cavity insert/s into a secondary mould and blow foam around the assembled fin plug and cavity inserts. The foam fills all the exposed voids/holes in the fin plug and bonds to the desired surfaces of the fin plug. The secondary mould is designed to preferably exclude foam from bonding to undesirable surfaces of the fin plug and the cavity infill.
6) Machine/cut any excess foam from the fin plug so that the upper and lower surfaces (e.g. top surface 15 and bottom surface 20) of the plug are exposed and the forms of the composite foam and fin plug assembly as described above are ready for service.

It will be readily appreciated that a similar manufacturing technique may be used where a pre-formed foam body 40 is desired which is then subsequently joined or bonded with a fin plug. For example the subsequent joining as illustrated and described above with respect to FIGS. 3A and 3B with 10A to 10H.

First Example Installation Technique for the Composite Foam and Fin Plug Assembly of the above.

Typically prior to the installation of a fin plug into a surfboard the surfboard foam blank has been shaped with the fin/s position/s marked on the underside by the shaper of the surfboard. The foam blank may or may not have one or more glass layers. The steps to subsequently install the composite foam and fin plug assembly may include:

I. Use a router to make rebates in the surfboard foam blank to correspond to the foam body of the composite foam and fin plug assembly. The fin position marks may be referenced to position a specific router template guide for making the rebates. The router template guide may be used to guide the router to the corresponding sidewall profile of the foam body and the corresponding depth of the foam body and fin plug assembly.
II. Insert an installation jig into and about each of the rebates for the composite foam and fin plug assemblies (if a multi-fin surfboard for example). The installation jig is used to adjust a cant and a toe angle of the fin plug for the fin that will be later inserted into the fin plug. The installation jig may be taped in place until the resin used to secure the composite foam and the fin plug assembly has set
III. Pour a mix of resin and filler (cabosil, milled or chopped fiberglass matt fibres, etc.) into the rebate cavity and press the composite foam and fin plug assembly into the rebate until the top surface 15 of the fin plug is flush with exterior surface of the foam blank of the surfboard.
IV. Adjust the toe and the cant angles of the fin plug with the aid of installation jig.
V. Once the resin has set remove the installation jigs and continue to apply glass layers 60 to the surfboard as is usually done in surfboard or water craft manufacture. For example to the overall surfboard apply fiberglass fabric/matt layers and successively impregnate with resin. Then apply a final filler or finish coat of a glass layer and then sand and polish to a final finish.
VI. The openings 30 for the fin cavities 25 may be opened up by: using the cross hair marks 54 on the cavity insert 50 to align a second router template guide over the fin plug, then using a router to remove the glass layer 60 immediately above the cavity insert 50. Alternatively where tenting 64 of the glass layer 60 is present then a skilled craftsman may sand back the raised glass layer of the tented region 64 until the glass layer 60 above the raised top cavity infill 50A has been sufficiently removed for the raised cavity infill 50A to be extracted cleanly.
VII. Appropriately finish the edges of the opening 30 in the glass layer 60 to the fin cavity 25.

First Example Advantages of the Composite Foam and Fin Plug Assembly Manufacturing Process for the Example Above and as Described Herein:

The following advantages may be provided:

(a) No stickers are required to cover the openings 30 of the fin cavities 25. The use of stickers or masking tape may be time consuming and prone to failure leading to resin and the like flowing into the fin cavities.

(b) As the fin plug sits flush with the foam blank surface of the surf board it is quicker and easier to apply the glass layer 60 to and about the composite foam and fin plug assembly. More attention is required to remove air bubbles and position the glass layer around fin plugs which have a raised lip about the openings to the fin cavities.

(c) It is easier to sand fiberglass laps during a glassing process and the final sanding and polishing process.

(d) The glass layer covers the whole surface of the composite foam and fin plug top surface 15, except the openings 30 to the fin cavities 25. This provides a stronger mechanical coupling between the top surface 15 and the rest of the surfboard by increasing the surface area for the glass layer 60 to bond and mechanically key to the top surface 15. Prior art fin plugs with a ramp or a raised lip about the openings to the fin cavities may suffer from the glass layer about the openings receding or feathering away from the openings and fin cavities when sanded.

(e) The chemical and mechanical bonding of the resin to the foam at the top surface provides an improved bonding compared with bonding only to a plastic or otherwise surface of prior art fin plugs.

(f) The use of a cavity insert 50 facilitates the use of the installation jig to adjust the cant and toe angles of the fin plug by providing a flush reference surface to adjust the angles against.

(g) Improved aesthetic qualities of having the preferably high density, structural foam becoming an appealing feature as well as indicating that a superior fin plug and installation process has been used for the particular water craft or surfboard.

Second Example Manufacturing Technique of the Composite Foam and Fin Plug Assembly.

An alternative to the first example manufacturing technique is to sacrifice the first cavity insert at step 6) when excess foam is being removed. In situations where the foam has covered the top surface 15 and the cavity insert 50, it may be more economic and time efficient to use a router or other tool to remove the foam above the cavity insert without precautions to maintain the integrity of the cavity insert. A new cavity insert may be used to replace the cavity insert used in foam moulding. The new cavity insert would also have the cross hair markers 54 for guiding the positioning of the second template guide when using a router to obtain access to the fin cavities through the glass layer 60.

The use of a sacrificial cavity insert may then be used for the forming of the composite foam and fin plug assembly of the first example for the example Figures referenced. It may be particularly useful where the excess of foam to the top surface 15 is so much that the cavity insert cannot be seen.

Sacrificial cavity inserts may also be used for the composite foam and fin plugs assemblies of FIGS. 11A to 11H and 12A to 12G where an alternate first foam layer 40A, without holes 25A, is applied or injection moulded to the top surface of the fin plug. The subsequent opening of the holes 25A for the fin cavities may be done with reduced care to the cavity insert integrity. A second cavity insert may be used to replace the sacrificed cavity insert, prior to installation into the foam blank.

Second Example Installation Technique for the Composite Foam and Fin Plug Assembly.

An alternative to the first example installation technique is the separate installation of the pre-formed foam body 40, 40B, 24, 540, 1940, 2040 into the foam blank prior to the fin plug 10. It has been described above that the foam body for the fin plug may be pre-formed to the fin plug. The pre-formed foam body may be separately installed into the foam blank with an appropriate installation jig as per steps II to IV of the first example. Then additional steps may be included to then separately install the fin plug by joining or otherwise adhering the fin plug to the foam body, which is already installed in the foam blank.

Where the pre-formed foam body is separately installed then it may be supplied as in an assembly kit that includes a fin plug, a pre-formed foam body, adhesive/s, cutting or routing templates, suitable installation jigs and instructions.

The assembly kit may also be suitable for also assembling a composite foam and fin plug assembly which then may be installed into the foam blank as described for the first example installation technique.

In this specification, terms denoting direction, such as vertical, up, down, left, right etc. or rotation, should be taken to refer to the directions or rotations relative to the corresponding drawing rather than to absolute directions or rotations unless the context require otherwise.

Where ever it is used, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

It will be understood that the invention disclosed and defined herein extends to all alternative combinations of two or more of the individual features mentioned or evident from the text. All of these different combinations constitute various alternative aspects of the invention.

While particular embodiments of this invention have been described, it will be evident to those skilled in the art that the present invention may be embodied in other specific forms without departing from the essential characteristics thereof. The present embodiments and examples are therefore to be considered in all respects as illustrative and not restrictive, and all modifications which would be obvious to those skilled in the art are therefore intended to be embraced therein.

The invention claimed is:

1. A composite foam and fin plug assembly for a fin including:

a fin plug of plastic material, having a top surface surrounding at least one fin cavity in the fin plug for receiving a base element of the fin, the at least one fin cavity extending inwardly from at least one opening in the top surface; and at least one recess or aperture in the top surface;

wherein the at least one recess or aperture in the top surface is filled with foam; and wherein the at least one recess or aperture in the top surface filled with foam forms a surface for bonding with an overlying glass layer of a water craft when the composite foam and fin plug assembly is installed in the water craft.

2. The composite foam and fin plug assembly according to claim 1, wherein said fin plug includes a plurality of said apertures in the top surface and at least some of the plurality of apertures are filled with foam.

3. The composite foam and fin plug assembly according to claim 2, wherein at least a portion of the top surface is a lattice formed by the plurality of apertures.

4. The composite foam and fin plug assembly according to claim 1, wherein said fin plug includes two fin cavities for receiving two base elements of the fin, the fin cavities extending inwardly from two openings in the top surface and downwardly into the base portion.

5. The composite foam and fin plug assembly according to claim 1, wherein the at least one aperture has a length of up to about 0.5 cm.

6. The composite foam and fin plug assembly according to claim 1, wherein the top surface defines a flange adjacent a fin plug cavity opening.

7. The composite foam and fin plug assembly according to claim 1, further including at least one aperture or recess extending downwardly to a base portion; wherein the base portion substantially includes at least one fin cavity.

8. The composite foam and fin plug assembly according to claim 7, further including the foam, filling the at least one aperture or recess, substantially surrounding the fin cavity and filling the base portion.

9. The composite foam and fin plug assembly according to claim 7, wherein the at least one aperture has a length of up to about 2 cm.

10. The composite foam and fin plug assembly according to claim 1, wherein the foam filling at least one aperture is integrally formed with a foam body which underlies the top surface of the fin plug.

11. The composite foam and fin plug assembly according to claim 10, further including the foam body substantially surrounding a base portion of the fin plug;

wherein the base portion extends downwardly from the top surface and substantially includes at least one fin cavity.

12. The composite foam and fin plug assembly according to claim 11, wherein the foam body includes a pre-formed foam body, a foam body formed by an injection moulding process or a plurality of in-fills corresponding to a plurality of the apertures.

13. The composite foam and fin plug assembly according to claim 11, wherein the foam body has a sidewall extending about the foam body.

14. The composite foam and fin plug assembly according to claim 13, wherein the foam body sidewall has a profile which is substantially continuous with an external perimeter of the top surface.

15. The composite foam and fin plug assembly according to claim 11, wherein the foam body has a thickness which is substantially equivalent to a distance from the top surface to a lowermost surface of the base portion of the fin plug.

16. The composite foam and fin plug assembly according to claim 1, wherein the foam filling the at least one recess or aperture in the top surface is substantially flush with said top surface.

17. The composite foam and fin plug assembly according to claim 1, wherein the foam filling the at least one recess or aperture in the top surface continues across the top surface and is offset from a raised portion of the top surface immediately surrounding a fin plug cavity opening.

18. A method of installing into a water craft a composite foam and fin plug assembly, of claim 1, said method including the steps of:

(a) provide the composite foam and fin plug assembly;

(b) protect or block up each fin cavity of the fin plug with a material to inhibit fluid material entering into each fin cavity;

(c) provide a water craft blank;

(d) make position markings on an underside of the water craft blank corresponding to a desired position for the composite foam and fin plug assembly in the water craft blank;

(e) route out a plug hole in the underside of water craft blank, said plug hole being adapted to receive the composite foam and fin plug assembly;

(f) pour an amount of resinous material into the plughole to form a layer of resinous material between a surface of the plug hole and a corresponding surface of the composite foam and fin plug assembly;

(g) insert the composite foam and fin plug assembly into the plug hole so that the top surface of the composite foam and fin plug assembly is substantially flush with the underside of the water craft blank or an opening of the plug hole;

(h) connect an installation jig to the composite foam and fin plug assembly by inserting one or more tabs of said installation jig into the at least one fin cavity of the composite foam and fin plug assembly;

(i) adjust a cant angle and a toe angle for the fin as desired;

(j) secure the installation jig in a desired orientation for the desired cant and toe angles of the fin;

(k) once resinous material has set, remove the installation jig;

(l) apply fibreglass and coating of resinous material to external surfaces of the water craft blank, including over the top surface of the composite foam and fin plug assembly;

(m) perform sanding of the external surface of the water craft as required; and (n) remove a layer of fibreglass and resinous material above each fin cavity opening, including the protection or block-up for each fin cavity.

19. A composite foam and fin plug assembly for a water craft, said composite foam and fin plug assembly including:

a fin plug having a top surface and at least one fin cavity for receiving a base element of a fin, said at least one fin cavity extending inwardly from at least one opening in the top surface;

a first foam layer overlying said top surface, said first foam layer including at least one aperture aligned with, and forming an opening to, said at least one fin cavity; and a second foam layer which with the first foam layer, at least one of sandwiches and encapsulates the fin plug;

wherein the first foam layer couples to the top surface, and wherein the first foam layer forms a surface for bonding with an overlying glass layer of the water craft when the composite foam and fin plug assembly is installed in the water craft.

20. A composite foam and fin plug assembly for a water craft, said composite foam and fin plug assembly including:

a fin plug having a top surface, with an external perimeter surface about the top surface, and at least one fin cavity for receiving a base element of a fin;

said at least one fin cavity extending inwardly from at least one opening in the top surface; and a foam body having a cavity corresponding to the fin plug in which said fin plug is positioned, said foam body also including a peripheral ridge which extends about the external perimeter surface of the fin plug to form the composite foam and fin plug assembly;

wherein the peripheral ridge of the foam body couples to the external perimeter surface of the fin plug.

21. The composite foam and fin plug assembly according to claim 20, further including:

a foam layer overlying and coupling to said top surface, said foam layer including at least one aperture aligned with, and forming an opening to, said at least one fin cavity;

wherein the foam layer overlying and coupling to the top surface is adapted to form a surface for bonding with an overlying glass layer of the water craft when the composite foam and fin plug assembly is installed in the water craft.

* * * * *